US012408706B2

(12) United States Patent
Oliana

(10) Patent No.: US 12,408,706 B2
(45) Date of Patent: Sep. 9, 2025

(54) AEROSOL-GENERATING DEVICE PROVIDING GESTURE INITIATION OF A STATUS QUERY

(71) Applicant: Philip Morris Products S.A., Neuchatel (CH)

(72) Inventor: Valerio Oliana, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 439 days.

(21) Appl. No.: 18/003,045

(22) PCT Filed: Jun. 30, 2021

(86) PCT No.: PCT/EP2021/068098
§ 371 (c)(1),
(2) Date: Dec. 22, 2022

(87) PCT Pub. No.: WO2022/003071
PCT Pub. Date: Jan. 6, 2022

(65) Prior Publication Data

US 2023/0255268 A1 Aug. 17, 2023

(30) Foreign Application Priority Data

Jun. 30, 2020 (EP) ..... 20183296

(51) Int. Cl.
*A24F 40/53* (2020.01)
*A24F 40/20* (2020.01)
(Continued)

(52) U.S. Cl.
CPC ..... *A24F 40/53* (2020.01); *A24F 40/20* (2020.01); *A24F 40/51* (2020.01); *A24F 40/60* (2020.01)

(58) Field of Classification Search
None
See application file for complete search history.

(56) References Cited

U.S. PATENT DOCUMENTS

2015/0257445 A1 9/2015 Henry, Jr. et al.
2016/0158782 A1 6/2016 Henry, Jr. et al.
(Continued)

FOREIGN PATENT DOCUMENTS

EP 3 039 973 A1 7/2016
JP 2017509339 A 4/2017
(Continued)

OTHER PUBLICATIONS

Combined Russian Office Action and Search Report issued Nov. 20, 2024 in Russian Patent Application No. 2023101753/03 (with English Translation of Office Action only), 9 pages.
(Continued)

*Primary Examiner* — Cynthia Szewczyk
(74) *Attorney, Agent, or Firm* — Oblon, McClelland, Maier &Neustadt, L.L.P.

(57) ABSTRACT

An aerosol-generating device is provided for generating an aerosol during a usage session, the aerosol-generating device including: an indicator system; a motion detector; and a controller; the motion detection unit being configured to detect movement of the device and to identify a first gesture and a second gesture different from the first gesture, in which, in response to the first gesture being identified by the motion detector, the controller is configured to control the indicator system to output a user detectable indication indicative of progress of the usage session, and in which, in response to the second gesture being identified by the motion detector, the controller is further configured to control the indicator system to output a user detectable indication indicative of the number of usage sessions available.

15 Claims, 8 Drawing Sheets

(51) Int. Cl.
*A24F 40/51* (2020.01)
*A24F 40/60* (2020.01)

(56) References Cited

U.S. PATENT DOCUMENTS

| | | | | |
|---|---|---|---|---|
| 2016/0206005 | A1 | 7/2016 | Yamada et al. | |
| 2018/0132528 | A1* | 5/2018 | Sur | A24F 40/50 |
| 2019/0289915 | A1 | 9/2019 | Heidl et al. | |

FOREIGN PATENT DOCUMENTS

| | | | |
|---|---|---|---|
| JP | 2018504095 | A | 2/2018 |
| JP | 20195119094 | | 5/2018 |
| JP | 2019509727 | A | 4/2019 |
| RU | 2 655 596 | C2 | 5/2018 |
| RU | 2 700 021 | C2 | 9/2019 |
| RU | 2018 133 600 | A | 3/2020 |
| WO | WO 2015/009838 | A2 | 1/2015 |
| WO | WO 2016009202 | A1 | 1/2016 |
| WO | WO 2016/094225 | A1 | 6/2016 |
| WO | WO 2020/216765 | A1 | 10/2020 |
| WO | WO 2021/037403 | A1 | 3/2021 |
| WO | WO 2022/003072 | A1 | 1/2022 |

OTHER PUBLICATIONS

Extended European Search Report issued on Dec. 15, 2020 in European Patent Application No. 20183296.1, 9 pages.
International Search Report & Written Opinion issued Oct. 14, 2021, in PCT/EP2021/068098, filed on Jun. 30, 2021, 9 pages.
Israeli Office Action Issued Jun. 16, 2025 in corresponding Israeli Patent Application No. 299347. 5 pages, citing document 15 therein.
Japanese Notice of Allowance issued Jun. 30, 2025 in corresponding Japanese Patent Application No. 2022-660012, 2 pages, citing documents 16-19 therein.

* cited by examiner

AEROSOL-GENERATING DEVICE PROVIDING GESTURE INITIATION OF A STATUS QUERY

The invention relates to aerosol-generating devices configured to generate an aerosol during a usage session, and to methods of using such devices.

Aerosol-generating devices configured to generate an aerosol from an aerosol-forming substrate, such as a tobacco containing substrate, are known in the art. Typically, an inhalable aerosol is generated by the transfer of heat from a heat source to a physically separate aerosol-forming substrate or material, which may be located within, around or downstream of the heat source. An aerosol-forming substrate may be a liquid substrate contained in a reservoir. An aerosol-forming substrate may be a solid substrate. An aerosol-forming substrate may be a component part of a separate aerosol-generating article configured to engage with an aerosol-generating device to form an aerosol. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Some aerosol-generating devices comprise a power source such as a battery for providing energy to generate the aerosol. As many aerosol-generating devices are intended to be hand-held device, there is a limit on the space available within the device to accommodate the power supply. Thus, some aerosol-generating devices are configured to supply a finite number of user experiences before their power source needs to be replaced or recharged.

Some aerosol-generating devices are configured to provide user experiences that have a finite duration. For example, an aerosol-generating device may be configured to operate for a predetermined period of time in any single usage session. Aerosol-generating devices configured to be used with separate aerosol-generating articles may be configured to operate in discrete usage sessions lasting no longer than the time taken to deplete the aerosol-forming substrate within an individual aerosol-generating article.

A traditional combustible cigarette has a combustion line that moves along the cigarette as it is consumed and thereby provides a user with a constant visual indication of the progress through a user experience. A user is thus able to judge at any point in time how much of the cigarette is available to be consumed. In many aerosol-generating devices, such judgement is more difficult. Some devices provide an indication that a usage session will end shortly before the end of such a session, but this does not provide a user with information regarding progress of the usage session during the usage session. Information regarding progress may be particularly useful to a user where duration of a usage session is controlled by more than one parameter.

According to an aspect of the present invention, there is provided an aerosol-generating device for generating an aerosol from an aerosol-forming substrate. The aerosol-generating device is configured to generate the aerosol during a usage session. The aerosol-generating device comprises an indicator system, a motion detection unit configured to detect movement of the device and identify a gesture associated with the detected movement, and a controller. In response to the gesture being identified by the motion detection unit, the controller is configured to control the indicator system to output a user detectable indication indicative of progress of the usage session or the number of usage sessions available.

The motion detection unit may be configured to detect movement of the device and identify a first gesture associated with the detected movement and a second gesture different to the first gesture associated with the detected movement. In response to the first gesture being identified by the motion detection unit, the controller may be configured to control the indicator system to output a user detectable indication indicative of progress of the usage session. In response to the second gesture being identified by the motion detection unit the controller may be configured to control the indicator system to output a user detectable indication indicative of the number of usage sessions available.

According to an aspect of the present invention, there is provided an aerosol-generating device for generating an aerosol from an aerosol-forming substrate. The aerosol-generating device is configured to generate the aerosol during a usage session. The aerosol-generating device comprises an indicator system, a motion detection unit, and a controller. The motion detection unit is configured to detect movement of the device and identify a first gesture associated with the detected movement and a second gesture different to the first gesture associated with the detected movement. In response to the first gesture being identified by the motion detection unit, the controller is configured to control the indicator system to output a user detectable indication indicative of progress of the usage session. In response to the second gesture being identified by the motion detection unit the controller is configured to control the indicator system to output a user detectable indication indicative of the number of usage sessions available.

An aerosol-generating device is typically a hand-held device. An aerosol-generating device may, for example, have dimensions similar to a traditional cigar, or a traditional cigarette. A user may find it desirable to be able to check how many usages sessions the device is capable of delivering before needing a recharge. For example, a user may wish to know how many usage sessions are available before attempting to insert a consumable aerosol-generating article. Advantageously, the user can pick up the device and make a predetermined gesture with the device to obtain an indication of the number of usage sessions available. Such a predetermined gesture may become automatic on the user's part, with the benefit that a user is less likely to try and initiate a usage session when there is insufficient power available for the device to complete a usage session.

A user may be engaged in other activities, for example a conversation, while using the aerosol-generating device. In such circumstances, a user may wish to monitor progress of a usage session in a discrete and non-intrusive manner. For example, it may be beneficial if a user can instigate a status query, and obtain an indication of progress of a usage session, by moving the device in a predetermined gesture.

Where a user does not have appropriate feedback regarding progress of a usage session, there may be an inclination for the user to consume interact with the aerosol-generating device at a greater frequency. For example, if a user is unsure how much of their usage session remains, they may take more frequent puffs than they otherwise would, resulting in a more rapid depletion of the aerosol-forming substrate and, potentially, an earlier termination of their usage session than they would otherwise desire. The ability to use a gesture to discretely instigate a status query to monitor progress of a usage session may make a user more relaxed during the usage session and, therefore, make the user experience more enjoyable.

The aerosol-generating device may be configured to be used for a plurality of discrete usage sessions. For example, the plurality of discrete usage sessions may be between 2 and 20 discrete usage sessions. The aerosol-generating device may be configured to provide an integral number of usage sessions when the battery is fully charged, the integral number being between 2 and 20. The ability to instigate a status query and receive an indication representative of number of remaining usage sessions may allow a user to determine whether or not they need to recharge their device, for example before leaving home with the device.

The number of usage sessions available may be determined with respect to energy available in the power supply. The controller may be configured to query the power supply and receive information regarding a parameter, such as charge level of the power supply, or voltage of the power supply, that enable determination of the number of usage sessions available to be delivered without further charging.

In response to the gesture, for example the second gesture, being identified by the motion detection unit, the controller may be configured to receive information indicative of energy available in the power supply, and to control the indicator system to output a user detectable indication indicative of number of usage sessions available.

The power supply may be a battery and the energy available in the power supply may be the charge available in the battery.

The motion detection unit may comprise an accelerometer and/or a gyroscope for detecting motion of the device.

Gestures identified by the motion detection unit are preferably simple gestures that are easy for a user to repeatedly perform. The gesture, for example the first gesture or the second gesture, that is identified by the motion detection unit may be a gesture selected from the list comprising; lifting the device to a vertical position, shaking the device, tapping the device a predetermined number of times, for example double tapping the device, raising the device, twirling the device, and moving the device in a specific pattern.

The indicator system may comprise a light emitting indicator for providing a visual indication of number of usage sessions available, a visual indication of progress of the usage session, or for providing both a visual indication of number of usage sessions available and a visual indication of progress of the usage session.

The indicator system may comprise a haptic feedback unit for providing a haptic indication of number of usage sessions available, a haptic indication of progress of the usage session, or for providing both a haptic indication of number of usage sessions available and a haptic indication of progress of the usage session.

The indicator may comprise both a light emitting indicator and a haptic output unit to provide both visual and haptic indications.

The indicator system may separately or in addition comprise an audio feedback unit for providing an audible indication of number of usage sessions available, an audible indication of progress of the usage session, or for providing both an audible indication of number of usage sessions available and an audible indication of progress of the usage session.

An aerosol-generating device for generating an aerosol from an aerosol-forming substrate. The aerosol-generating device is configured to generate the aerosol during a usage session progressing through a plurality of sequential phases between a usage session start and a usage session stop. The aerosol-generating device comprises a timer, a haptic output unit, and a controller. Progress of the usage session through the plurality of sequential phases is controlled by the controller in response to timing signals from the timer and in response to signals representative of a monitored user interaction parameter. The controller is configured to control the haptic output unit to emit a different haptic output during each of the plurality of sequential phases to indicate progress of the usage session.

A hand-held aerosol-generating device has limited surface area on which to mount or otherwise locate information displays, such as indicators. Thus, displays that comprise a large number of display units, such as a large number of light emitting units, take up a significant area on the surface of a typical aerosol-generating device. Furthermore, displays that comprise a large number of display units also consume a large amount of energy. A typical aerosol-generating device has limited space for a power supply such as a battery and, thus, features that require high energy consumption require larger capacity, and therefore physically larger, power supplies. More complicated displays, such as screens, may be configurable to display a wide range of information, but also consume large amounts of energy and present other associated design complexities due to the need for a complicated electronic architecture and requirements to provide adequate power to the display and dissipate heat generated by the display.

A haptic output unit may be configured to emit a haptic output representative of current usage session phase in response to a user input. For example, a user may initiate a status query by, for example, pressing a button on the aerosol-generating device. The haptic output representative of the current usage session may then be emitted in response to the status query.

The haptic output unit may comprise a haptic actuator or haptic motor, for example an eccentric rotating mass actuator. A haptic output may be in the form of one or more vibrations or buzzes that are detectable by a user holding the device.

The haptic output unit may be configured to emit a haptic output representative of current usage session phase in response to a transition from one of the plurality of sequential phases to a subsequent one of the plurality of sequential phases. Thus, a haptic signal may be automatically emitted on transition from one phase to a subsequent phase. This may provide a user with an ongoing haptic indication of progress of the usage session.

The usage session may be a finite usage session, that is a usage session having a start and an end. The duration of the usage session as measured by time may be influenced by use during the usage session. The duration of the usage session may have a maximum duration determined by a maximum time from start of the usage session. The duration of the usage session may be less than the maximum duration if one or more monitored parameters reaches a predetermined threshold before the maximum time from the start of the usage session.

An aerosol-generating device capable of being queried and providing feedback indicative of progress of a usage session may allow a user to discretely monitor progress of a usage session while continuing other activities, such as conversing with others.

A usage session may be determined as a period of finite duration within which a user can obtain a user experience. The usage session may, for example extend between a start of the usage session, which may be termed, for example, a session start, and an end of the usage session, which may be termed, for example, a session stop. The session start may be determined to be the moment that the aerosol-generating device is actuated. For example, a user may manually initiate a usage session by actuating the aerosol-generating device, for example by pressing a button that actuates the aerosol-generating device. The aerosol-generating device may be configured to automatically initiate a usage session, for example in response to an aerosol-generating article being engaged with the aerosol-generating device.

The aerosol-generating device may be configured such that the usage session has a maximum duration determined by a timer. A maximum duration may ensure that a usage session is ended without further input from a user. An aerosol-generating device configured to provide a usage session having a maximum duration helps to maintain quality of the user experience by preventing a user from attempting to generate aerosol when an aerosol-forming substrate has been depleted. A usage session having a maximum duration also helps ensure safety, as an actuation system, typically involving a heater, is not left in an activated state in the event that a user forgets that a usage session has started. A usage session having a maximum duration also requires a user to make a conscious decision to start a further usage session, which may help the user to control aerosol intake.

The aerosol-generating device may be configured to receive an aerosol-generating article comprising the aerosol-forming substrate. For example, the aerosol-generating device may be configured to receive a cartridge containing an aerosol-forming substrate, for example a liquid aerosol-forming substrate. The aerosol-generating device may be configured to receive a heated aerosol-generating article comprising a solid aerosol-forming substrate.

The aerosol-generating device may be configured to detect the presence of the aerosol-generating article. Sensors or detectors in the device may detect the presence of the article and may be able to discriminate one article configured to be used with the device and another article configured to be used with the device. The device may be able to discriminate articles configured for use with the device and other articles not configured for use with the device. The device may be able to prevent initiation of a usage session if the aerosol-generating article is not an article configured for use with the device.

The aerosol-generating device may be configured such that the usage session is terminated if the aerosol-generating article is removed from the aerosol-generating device. Thus, in such a configuration, a usage session may be ended before a maximum duration in the event that a user removes an article from the device during a usage session. This may improve both safety and user experience.

The aerosol-generating device may be configured to monitor a user interaction parameter indicative of use of the aerosol-generating device during the usage session. The usage session may be configured to be terminated if the user interaction parameter reaches a predetermined threshold. Thus, in such a configuration, a usage session may be ended before a maximum duration in the event that a monitored user interaction parameter reaches a threshold before a maximum duration of the usage session is reached. In the event that a user has been using the device heavily during the usage session the aerosol-forming substrate may be depleted more quickly than would be the case if the user had not been using the device heavily. Thus, the ability to monitor and terminate the usage session when a user interaction parameter reaches a predetermined threshold may improve the user experience by preventing aerosol generation from a depleted aerosol-generating article. To continue use, a user may need to replace the article and start a further usage session.

As an example, the user interaction parameter may be indicative of user puffs taken during the usage session. The aerosol-generating device may comprise a puff counting mechanism to determine number of user puffs taken during the usage session. The aerosol-generating device may be configured to terminate the usage session when the number of user puffs taken during the usage session reaches a predetermined threshold. Thus, a usage session may comprise a limited number of puffs that can be taken by a user. A usage session may be terminated before a maximum duration determined by a timer if the number of puffs taken during the usage session reaches the predetermined threshold before a maximum duration determined by a timer. Thus, in the event that a user depletes an aerosol-forming substrate by taking a large number of puffs in a short space of time, the user experience is maintained by preventing puffs being taken after the aerosol-forming substrate has been depleted.

Where the length of a usage session is determined by more than one threshold, for example a maximum duration determined by a time threshold and a threshold determined by one or more user interaction parameter, a representative indication of progress through the usage session becomes more complicated.

The usage session is determined to comprise a plurality of sequential phases. Progress of the usage session as a whole may be determined relative to progress through the plurality of sequential phases. The plurality of sequential phases may be at least three sequential phases, or at least four sequential phases. For example, the plurality of sequential phases may comprise at least five sequential phases, or at least six sequential phases. The greater the number of phases a usage session is divided into, the greater the accuracy of a progress indication during the session. However, if the number of phases is too great, the indication of progress may become confusing and of little practical benefit to a user.

The aerosol-generating device may be configured such that any, or each, of the plurality of sequential phases has a phase duration defined by a phase start and a phase end. The aerosol-generating device may be configured such that any, or each, of the plurality of sequential phases has a maximum phase duration determined by a timer. Thus, any, or each, of the plurality of sequential phases may end when a monitored period of time reaches a predetermined threshold for the phase, if the phase has not ended sooner.

A first phase of the plurality of sequential phases may have a first phase duration, for example defined by a first phase start and a first phase end. The first phase may be deemed to start at the session start of the usage session.

Where the aerosol-generating device comprises a heater, the first phase may include a heating period in which a heating element increases in temperature from an ambient temperature to an operational temperature for generating an aerosol.

A first phase of the plurality of sequential phases may have a first phase duration, for example defined by a first phase start and a first phase end, in which the first phase may be deemed to start at the end of a pre-phase heating period, the pre-phase heating period starting at the session start. The pre-phase heating period may be a heating period in which a heating element increases in temperature from an ambient temperature to an operational temperature for generating an aerosol.

A second phase of the plurality of sequential phases may have a second phase duration defined by a second phase start and a second phase end. The second phase may start at the end of the first phase.

A third phase of the plurality of sequential phases may have a third phase duration defined by a third phase start and a third phase end. The third phase may start at the end of the second phase. The usage session may end at the end of the third phase. Thus, the usage session may be divided into three phases, each phase having its own duration, with the usage session ending at the end of the third phase. Progress through the usage session may then be determined by determining which phase the usage session is in at any time during the usage session.

The usage session may be divided into more than three phases.

A fourth phase of the plurality of sequential phases may have a fourth phase duration defined by a fourth phase start and a fourth phase end. The fourth phase may start at the end of the third phase.

The usage session may end at the end of the fourth phase. Thus, the usage session may be divided into four phases, each phase having its own duration, with the usage session ending at the end of the fourth phase. Progress through the usage session may then be determined by determining which phase the usage session is in at any time during the usage session.

The usage session may be divided into more than four phases. A fifth phase of the plurality of sequential phases has a fifth phase duration may be defined by a fifth phase start and a fifth phase end. The fifth phase may start at the end of the fourth phase. The usage session may end at the end of the fifth phase.

The usage session may be divided into more than five phases. A sixth phase of the plurality of sequential phases may have a sixth phase duration defined by a sixth phase start and a sixth phase end. The sixth phase may starts at the end of the fifth phase. The usage session may end at the end of the sixth phase.

The aerosol-generating device may be configured to monitor a user interaction parameter indicative of use of the aerosol-generating device during the usage session. A duration of any, or each, of the plurality of sequential phases may be controlled with reference to the monitored user interaction parameter. Preferably, a duration of any, or each, of the plurality of sequential phases is controlled with reference to the user interaction parameter and at least one further parameter. The at least one further parameter is preferably passage of time determined by a timer.

Thus, progression of the usage session through each of the plurality of sequential phases may be determined by reference to both a timer, providing a maximum duration for each phase, and a monitored user interaction parameter, which may end the phase earlier than the maximum duration possible for that phase if the monitored user interaction parameter reaches a predetermined threshold.

The user interaction parameter may be indicative of user puffs taken during the usage session.

The user interaction parameter may be indicative of aerosol amount or aerosol volume released by the aerosol-forming substrate. The user interaction parameter may be indicative of aerosol amount or aerosol volume delivered to the user. The user interaction parameter may be a cumulative volume of aerosol delivered to a user.

The user interaction parameter may be indicative of power supplied to a heating element during the usage session.

The aerosol-generating device may comprise a puff counting mechanism to determine number of user puffs taken during the usage session. Puffs taken by a user may be determined, for example, by monitoring power supplied by the power supply during the usage session, or by monitoring temperature of a heating element during a usage session. Puffs taken by a user may be determined by monitoring air flow through the device during a usage session. Duration of any, or each, of the plurality of sequential phases may, therefore, be controlled with reference to the number of user puffs taken during the usage session.

The aerosol-generating device may be configured such that the usage session has a maximum usage session duration determined by a timer, and in which the aerosol-generating device is configured to record at least one user interaction parameter during the usage session. The phase duration of any, or each, of the plurality of sequential phases may have a duration less than a maximum phase duration if the value of the user interaction parameter reaches a predetermined threshold before the end of that phase.

The aerosol-generating device may be configured such that any, or each, of the plurality of sequential phases has a maximum phase duration determined by a timer, and in which the aerosol-generating device is configured to record at least one user interaction parameter during the usage session. The phase duration of any, or each, of the plurality of sequential phases may have a duration less than the maximum phase duration if the value of the user interaction parameter reaches a predetermined threshold before the end of that phase.

The usage session may, for example, comprise a first phase, a second phase, a third phase and a fourth phase. The first phase may start at the session start of the usage session. The first phase may end, and the second phase may therefore start, after a monitored period of time starting at a time monitoring start reaches a predetermined first phase time threshold, or after the recorded user interaction parameter reaches a first predetermined value if the first predetermined value is reached at a time preceding the predetermined first phase time threshold.

The second phase may end, and the third phase may therefore start, after a monitored time starting at the time monitoring start reaches a predetermined second phase time threshold, or after the recorded user interaction parameter reaches a second predetermined value if the second predetermined value is reached at a time preceding the predetermined second phase time threshold.

The third phase may end, and the fourth phase may therefore start, after a monitored time starting at the time monitoring start reaches a predetermined third phase time threshold, or after the recorded user interaction parameter reaches a third predetermined value if the third predetermined value is reached at a time preceding the predetermined third phase time threshold.

The fourth phase may end after a monitored time starting at the time monitoring start reaches a predetermined fourth phase time threshold, or after the recorded user interaction parameter reaches a fourth predetermined value if the fourth predetermined value is reached at a time preceding the predetermined fourth phase time threshold.

The time monitoring start may, conveniently, be the session start of the usage session. The recorded user interaction parameter may be representative of number of puffs taken by a user during the usage session.

The first phase time threshold may be a value of between 75 seconds and 105 seconds from the session start of the usage session. The first predetermined value may be 3 puffs or 4 puffs.

The second phase time threshold may be a value of between 150 seconds and 210 seconds from the session start of the usage session. The second predetermined value may be 6 puffs or 7 puffs.

The third phase time threshold may be a value of between 225 seconds and 315 seconds from the session start of the usage session. The third predetermined value may be 9 puffs or 10 puffs.

The fourth phase time threshold may be a value of between 300 seconds and 420 seconds from the session start of the usage session. The fourth predetermined value may be 12 puffs or 13 puffs.

In another example, the recorded user interaction parameter may be representative of volume of aerosol delivered to a user during the usage session. This parameter may be calculated, for example, by monitoring a power signal, detecting the start point and end point of user puffs, and integrating to determine total power provided during user puffs. From this total power provided, it may be possible to calculate volume of aerosol delivered.

For example, the device may configured to monitor a parameter indicative of aerosol generation, such as power supplied to a heater, during operation of the aerosol-generating device, analyse the monitored parameter to identify a user puff, the user puff defined by a puff start and a puff end, analyse the monitored parameter during the user puff to calculate a puff volume, the puff volume being a volume of aerosol generated during the user puff, and use the puff volume as the user interaction parameter.

The first phase time threshold may be a value of between 75 seconds and 105 seconds from the session start of the usage session. The first predetermined value may be between 50 ml and 200 ml of aerosol.

The second phase time threshold may be a value of between 150 seconds and 210 seconds from the session start of the usage session. The second predetermined value may be 100 ml and 400 ml of aerosol.

The third phase time threshold may be a value of between 225 seconds and 315 seconds from the session start of the usage session. The third predetermined value may be between 150 ml and 600 ml of aerosol.

The fourth phase time threshold may be a value of between 300 seconds and 420 seconds from the session start of the usage session. The fourth predetermined value may be between 200 ml and 800 ml of aerosol.

The usage session may comprise a final phase, which may be the fourth phase or a subsequent phase, and the final phase may end after a monitored period of time, for example after a time starting at the session start of the usage session reaches a predetermined final phase time threshold, or after a recorded user interaction parameter reaches a final predetermined value if the final predetermined value is reached before the predetermined final phase time threshold.

The usage session entering a final phase may, therefore, be an indication to the user that the usage session is about to end. The final phase may have a maximum duration that is shorter than the maximum duration of preceding phases.

The aerosol-generating device may comprise a haptic output unit. The aerosol-generating device may be configured such that the usage session comprises at least four sequential phases. When the first gesture is detected, the controller may be configured to instruct the haptic output unit to emit a different haptic output depending on which of each of the at least four sequential phases the usage session is in when the gesture is determined. A haptic output may be in the form of one or more vibrations or buzzes that are perceptible to a user holding the device.

During a first phase the haptic output unit may emit an output comprising a first number of vibrations, for example a first number of vibrations selected from the list comprising a single vibration, a double vibration, a triple vibration, and a quadruple vibration.

During a second phase the haptic output unit may emit an output comprising a second number of vibrations, for example a second number of vibrations selected from the list comprising a single vibration, a double vibration, a triple vibration, and a quadruple vibration, the haptic output emitted during the second phase being different to the haptic output emitted during the first phase.

During a third phase the haptic output unit may emit an output comprising a third number of vibrations, for example a third number of vibrations selected from the list comprising a single vibration, a double vibration, a triple vibration, and a quadruple vibration, the haptic output emitted during the third phase being different to the haptic output emitted during both of the first phase and the second phase.

During a fourth phase the haptic output unit may emit an output comprising a fourth number of vibrations, for example a fourth number of vibrations selected from the list comprising a single vibration, a double vibration, a triple vibration, and a quadruple vibration, the haptic output emitted during the fourth phase being different to the haptic output emitted during any of the first phase, the second phase, and the third phase.

The aerosol-generating device may comprise a light emitting indicator. The light emitting indicator may be a light emitting indicator having at least one light emitting unit and no more than two light emitting units. The light emitting indicator may be configured to display any one of at least three different indication modes during the usage session. The controller may be configured to control the light emitting indicator to display any one of the at least three indication modes to indicate progress of the usage session.

A hand-held aerosol-generating device has limited surface area on which to mount or otherwise locate information displays, such as indicators. Thus, displays that comprise a large number of display units, such as a large number of light emitting units, take up a significant area on the surface of a typical aerosol-generating device. Furthermore, displays that comprise a large number of display units also consume a large amount of energy. A typical aerosol-generating device has limited space for a power supply such as a battery and, thus, features that require high energy consumption require larger capacity, and therefore physically larger, power supplies. More complicated displays, such as screens, may be configurable to display a wide range of information, but also consume large amounts of energy and present other associated design complexities due to the need for a complicated electronic architecture and requirements to provide adequate power to the display and dissipate heat generated by the display.

A light emitting indicator comprising no more than two light emitting units does not take up a significant proportion of space on the aerosol-generating device. Each light emitting unit provides a single display area of the light emitting indicator. The display area of each light emitting unit may be small relative to the dimensions of the aerosol-generating device. A light emitting indicator comprising no more than two light emitting units may not consume a significant amount of energy compared with an indicator that comprises more than two light emitting units or a display screen, and may not generate a significant amount of heat to be dissipated. An aerosol-generating device comprising a light emitting indicator comprising no more than two light emitting units may have fewer components and a less complicated design, thereby reducing overall cost of the aerosol-generating device. Furthermore, a light emitting indicator comprising no more than two light emitting units may present progress information in a relatively simple way, thereby increasing convenience of a user.

The aerosol-generating device may comprise a light emitting indicator having at least one light emitting unit and no more than two light emitting units. The, or each, light emitting unit may be a light emitting diode (LED) unit. A LED unit may comprise one or more LED chips configured to emit light.

The, or each, light emitting unit may be configured to display in at least three operational states. The at least three operational states may be, for example, selected from a list comprising; consistently on, consistently off, blinking, and intensity modulated. Consistently on means the light emitting unit is switched on and is emitting light. Consistently off means the light emitting unit is switched off and is not emitting light. Blinking means that the light emitting unit is modulated between being switched off and being switched on, resulting in light being emitted in a blinking or flashing pattern. Intensity modulated means that power supplied to a light emitting source, for example a LED unit, is modulated. The light emitting unit emits a light that varies in intensity over a period of time and will appear to fluctuate between a bright appearance and a dull appearance.

Other operational states are possible. For example, frequency at which a light emitting unit is switched on and off may provide a rapid blinking state and a slow blinking state that is differentiable from the rapid blinking state.

The, either, or each, light emitting unit may be capable of being operated to emit light in a first colour and in a second colour.

The light emitting indicator may comprise a single light emitting unit capable of being operated to emit light in a first colour and in a second colour, the light emitting unit configured to display at least four operational states, the light emitting indicator thereby being capable of displaying in at least four indication modes. The at least four operational states may be selected from the list comprising: consistently off, first colour consistently on, first colour blinking, first colour intensity modulated, second colour consistently on, second colour blinking, second colour intensity modulated, and alternate first colour/second colour blinking.

The light emitting unit may be configured to display in at least three, four, or five operational modes and the light emitting indicator may be thereby capable of displaying in at least three, four, or five indication modes.

An aerosol-generating device may be configured such that the light emitting indicator consists of two light emitting units, a first light emitting unit and a second light emitting unit. Each of the light emitting units may be configured to display in a first operational state, a second operational state, and a third operational state. The controller may be configured to independently control the operational state of the first light emitting unit and the second light emitting unit to any one of a first, second, or third operational states such that the light emitting indicator displays in at least three or at least four indication modes. The light emitting indicator may be configured to display in at least five indication modes or at least six indication modes. For example, the usage session may comprise at least three or four sequential phases and the light emitting indicator may be configured to display a different indication mode at or during each of the sequential phases.

During a first phase the light emitting indicator may display in a first indication mode resulting from the first light emitting unit displaying a first operational state and the second light emitting unit displaying a first operational state.

During a second phase the light emitting indicator may display in a second indication mode resulting from the first light emitting unit displaying a first operational state and the second light emitting unit displaying a second operational state During a third phase the light emitting indicator may display in a third indication mode resulting from the first light emitting unit displaying a first operational state and the second light emitting unit displaying a third operational state During a fourth phase, if a fourth phase is present, the light emitting indicator may display in a fourth indication mode resulting from the first light emitting unit displaying a second operational state and the second light emitting unit displaying a second operational state.

During a fifth phase, if a fifth phase is present, the light emitting indicator may display in a fifth indication mode resulting from the first light emitting unit displaying a third operational state and the second light emitting unit displaying a third operational state.

Thus, an aerosol-generating device may be configured to generate an aerosol during a finite usage session. The usage session may be divided into a plurality of sequential phases. A controller may be configured to determine and control the duration of the usage session with reference to monitored parameters. The controller may also determine and control the duration of each of the plurality of phases with reference to monitored parameters. The length of the usage session and of any phase within the usage session may have a maximum duration or a latest end point determined by a timing threshold. The length of the usage session and of any phase during the usage session may have a duration less than the maximum duration allowed by the timing threshold if one or more monitored parameters reach a threshold. The controller may be able to determine which phase of the usage session the device is in. A motion detection unit may be configured to detect a gesture made by a user. The gesture may initiate a status query regarding number of usage sessions available. The gesture may initiate a status query regarding progress of a current usage session. The controller is configured to control an indicator system to emit an output in response to the status query.

The aerosol-generating device may comprise a heater for heating an aerosol-forming substrate to form an aerosol. The heater may be an induction heater. An induction heater may comprise an inductor configured to generate a fluctuating magnetic field designed to heat a susceptor. The heater may be a resistance heater.

The heater may comprise a heating element for heating a consumable aerosol-generating article. The heating element may be an internal heater designed to be inserted into a consumable aerosol-generating article, for example a resistive heating element or a susceptor in the form of a pin or blade that can be inserted into an aerosol-forming substrate located within a consumable aerosol-generating article. The heating element may be an external heater designed to heat an external surface of a consumable aerosol-generating article, for example a resistive heating element or a susceptor located at the periphery of, or surrounding, a substrate receiving cavity for receiving the consumable aerosol-generating article.

The aerosol-generating device may be configured such that power is supplied to the heater to maintain the heater at a predetermined temperature during the usage session.

Power may be supplied to the heater to increase the temperature of a heater element to an operating temperature range for generating an aerosol, the heater element remaining within the operating temperature range until the end of the usage session. Power may be supplied to the heater during the usage session both when a user is taking a puff and when a user is not taking a puff. In such a configuration, the power supplied during a user puff is likely to be greater than that supplied when a user is not talking a puff, as less power with be required to maintain the temperature of the heater between puffs.

The aerosol-generating device may comprise a replaceable substrate section containing an aerosol-forming substrate. The replaceable substrate section may form a portion of body of the aerosol-generating device and may itself locate or contain a portion of aerosol-forming substrate for consumption in the device. The replaceable substrate section may be located distal to the proximal end of the device, for example distal to a mouthpiece. The replaceable substrate section may be located proximal to the distal end of the device. The replaceable substrate section may be coupled to one or more other sections forming the body of the aerosol-generating device by coupling means such as screw threads, or bayonet fitting, or magnetic connection, or mechanical latching means such as snap fits or interference fit.

A replaceable substrate section may comprise a reservoir of liquid aerosol-forming substrate. For example, a replaceable substrate section may comprise a reservoir of a liquid comprising nicotine and an aerosol former such as propylene glycol or glycerine. Alternatively, a replaceable substrate section may comprise a container of solid aerosol-forming substrate, or a container of colloidal aerosol-forming substrate such as a gel substrate.

The aerosol-generating device may comprise a replaceable substrate section containing two or more components which form an aerosol when combined.

A replaceable substrate section may comprise an atomizer, such as a heating element for heating the aerosol-forming substrate, or for heating at least one of the two or more components which form an aerosol when combined. Thus, a replaceable substrate section may be a form of cartomizer and include both an aerosol-forming substrate and an atomizing component. The replaceable substrate section would, in such embodiments, preferably include electrical contacts configured to contact corresponding electrical contacts on a battery portion of the aerosol-generating device to provide power for actuation of the atomizer.

In an example, the atomizer may be a resistance heater such as a resistive wire, or a resistive track on a substrate. In other examples, the atomizer may be an inductive susceptor capable of heating when within a fluctuating magnetic field generated by an inductive coil.

An aerosol-generating device may be configured to receive an aerosol-generating article comprising the aerosol-forming substrate. The aerosol-forming substrate may be a solid aerosol-forming substrate. The aerosol-generating device may, for example, comprise a substrate receiving cavity for receiving a consumable aerosol-generating article comprising an aerosol-forming substrate. Examples of aerosol-generating articles include sachets filled with solid aerosol-forming substrates, cigarettes and cigarette-like articles that include an aerosol-forming substrate contained within a wrapper such as a cigarette paper, capsules or containers of liquid aerosol-forming substrate or colloidal aerosol-forming substrate. The consumable aerosol-generating article may comprise a replaceable substrate section containing two or more components which form an aerosol when combined.

A consumable aerosol-generating article may comprise an atomizer, such as a heating element for heating the aerosol-forming substrate, or for heating at least one of the two or more components which form an aerosol when combined. Thus, a consumable aerosol-generating article may be a form of cartomizer and include both an aerosol-forming substrate and an atomizing component. The consumable aerosol-generating article would, in such embodiments, preferably include electrical contacts configured to contact corresponding electrical contacts on a battery portion of the aerosol-generating device to provide power for actuation of the atomizer.

In examples, the atomizer may be a resistance heater such as a resistive wire, or a resistive track on a substrate. In other embodiments, the atomizer may be an inductive susceptor capable of heating when within a fluctuating magnetic field generated by an inductive coil.

A preferred consumable aerosol-generating article may be in the form of a cigarette or cigarette-like article comprising a solid aerosol-forming substrate contained within a wrapper. Preferably such an article includes a mouth end intended to be inserted into a user's mouth for consumption of the article. Preferably, the mouth end includes a filter to emulate a conventional tailored cigarette. Preferably, the consumable aerosol-generating article is configured to interact with an atomizer, preferably a heater, located in the body of the aerosol-generating device. Thus, a heating means such as a resistance heating element may be located in or around the substrate receiving cavity for receiving the consumable aerosol-generating article. The substrate receiving cavity may be located at a proximal end of the device. For example, an opening to the substrate receiving cavity may be located at the proximal end of the device.

An aerosol-generating system may comprise an aerosol-generating as described above and an aerosol-generating article configured to be received by the aerosol-generating device, the aerosol-generating article comprising the aerosol-forming substrate.

An aerosol-generating system may further comprise a charging device for charging the aerosol-generating device. A charging device may comprise a primary power source and may have a docking arrangement configured to engage with the aerosol-generating device.

According to an aspect of the invention, there is provided a method of providing user information in an aerosol-generating device for generating an aerosol from an aerosol-forming substrate during a usage session. The aerosol-generating device comprises an indicator system, and a motion detection unit configured to detect movement of the device and identify a gesture associated with the detected movement. The method comprises steps of; detecting movement of the device, determining if the movement corresponds to the gesture, and if the movement corresponds to the gesture, controlling the indicator system to output a user detectable indication indicative of progress of the usage session.

The aerosol-generating device may comprise a power supply. The aerosol-generating device may comprise a motion detection unit configured to detect movement of the device and identify a first gesture associated with the detected movement and a second gesture different to the first gesture associated with the detected movement. The method may comprise steps of detecting movement of the device, determining if the movement corresponds to the first gesture or the second gesture, and if the movement corresponds to the first gesture, controlling the indicator system to output a user detectable indication indicative of progress of the usage session.

The method may comprise steps of determining if the movement corresponds to the first gesture or the second gesture, and if the movement corresponds to the second gesture controlling the indicator system to output a user detectable indication indicative of number of usage sessions available.

The method may comprise the further steps of defining a plurality of sequential phases between a user session start and a user session stop, and in response to the gesture being the first gesture, controlling the indicator system to output a different output during each of the plurality of sequential phases of the usage session.

The method may comprise the further steps of, recording a user interaction parameter during the usage session, and determining the duration of each of a plurality of sequential phases of the usage session based on timing information and a value of the user interaction parameter.

According to an aspect of the invention, there is provided an aerosol-generating device for generating an aerosol from an aerosol-forming substrate. The aerosol-generating device is configured to generate the aerosol during a usage session, and comprises, an indicator system, a motion detection unit configured to detect movement of the device and identify a first gesture associated with the detected movement, and a controller. The aerosol-generating device comprises a computer readable medium containing instructions to carry out a method of detecting movement of the device, determining if the movement corresponds to the gesture, and if the movement corresponds to the gesture, controlling the indicator system to output a user detectable indication indicative of progress of the usage session.

According to an aspect of the invention, there is provided an aerosol-generating device for generating an aerosol from an aerosol-forming substrate. The aerosol-generating device is configured to generate the aerosol during a usage session, and comprises a power supply, an indicator system, a motion detection unit configured to detect movement of the device and identify a gesture associated with the detected movement, and a controller. In response to the gesture being identified by the motion detection unit the controller is configured to control the indicator system to output a user detectable indication indicative of number of usage sessions available.

The aerosol-generating may be configured to be used for a plurality of discrete usage sessions. For example, the plurality of discrete usage sessions may be between 2 and 20 discrete usage sessions. The aerosol-generating device may be configured to provide an integral number of usage sessions when the battery is fully charged, the integral number being between 2 and 20.

The number of usage sessions available may be determined with respect to energy available in the power supply.

In response to the gesture being identified by the motion detection unit, the controller may be configured to receive information indicative of energy available in the power supply, and to control the indicator system to output a user detectable indication indicative of number of usage sessions available.

The power supply may be a battery and the energy available in the power supply may be the charge available in the battery.

The motion detection unit may comprise an accelerometer and/or a gyroscope.

The gesture identified by the motion detection unit may be a gesture selected from the list comprising; lifting the device to a vertical position, shaking the device, tapping the device a predetermined number of times, for example double tapping the device, raising the device, twirling the device, and moving the device in a specific pattern.

The indicator system may comprise a light emitting indicator. The indicator system may comprise a haptic feedback unit. The indicator system may comprise an audio feedback unit.

The user detectable indication indicative of number of usage sessions available may comprise an audible indication. The user detectable indication indicative of number of usage sessions available may comprise a haptic indication. The user detectable indication indicative of number of usage sessions available may comprise a visual indication.

The usage session may extend between a session start and a session stop. The aerosol-generating device may be configured such that the usage session has a maximum duration determined by a timer. The aerosol-generating device may be configured to receive an aerosol-generating article comprising the aerosol-forming substrate. The aerosol-generating device may be configured to detect the presence of the aerosol-generating article. The usage session is terminated if the aerosol-generating article is removed from the aerosol-generating device.

According to an aspect of the invention, there is provided a method of providing user information in an aerosol-generating device for generating an aerosol from an aerosol-forming substrate during a usage session. The aerosol-generating device comprises a power supply, an indicator system, and a motion detection unit configured to detect movement of the device and identify a gesture associated with the detected movement. The method comprises steps of detecting movement of the device, determining if the movement corresponds to the gesture, and if the movement corresponds to the gesture, controlling the indicator system to output a user detectable indication indicative of number of usage sessions available.

According to an aspect of the invention, there is provided an aerosol-generating device for generating an aerosol from an aerosol-forming substrate configured to generate the aerosol during a usage session. The aerosol-generating device comprises a power supply, an indicator system, a motion detection unit configured to detect movement of the device and identify a gesture associated with the detected movement, and a controller. The aerosol-generating device comprises a computer readable medium containing instructions to carry out a method comprising steps of detecting movement of the device, determining if the movement corresponds to the gesture, and if the movement corresponds to the gesture, controlling the indicator system to output a user detectable indication indicative of number of usage sessions available.

As used herein, the term 'aerosol-generating device' refers to a device that interacts with an aerosol-forming substrate to generate an aerosol that is directly inhalable into a user's lungs thorough the user's mouth. In certain embodiments, an aerosol-generating device may heat an aerosol-forming substrate to facilitate the release of the volatile compounds. An aerosol-generating device may interact with an aerosol-generating article comprising an aerosol-forming substrate or a cartridge comprising an aerosol-forming substrate. An electrically operated aerosol-generating device may comprise an atomiser, such as an electric heater, to heat the aerosol-forming substrate to form an aerosol.

As used herein, the term 'aerosol-generating article' refers to an article comprising an aerosol-forming substrate capable of releasing volatile compounds, which can form an aerosol. In certain embodiments, the aerosol-generating article may comprise an aerosol-forming substrate capable of releasing upon heating volatile compounds, which can form an aerosol.

As used herein, the term 'usage session' refers to an operational period of the aerosol-generating device having a finite duration. A usage session may be initiated by the action of a user. A usage session may be terminated after a predetermined period of time has elapsed from the initiation of the usage session. A usage session may be terminated after a monitored parameter has reached a threshold during the usage session. Typically, a usage session has a duration that allows a user to enjoy a single user experience. For example, in certain aerosol-generating devices, a usage session may have a duration that allows the user to consume a single disposable aerosol-generating article. After a usage session has been terminated, further action is required by a user to initiate a subsequent usage session.

As used herein, the term 'haptic output unit' refers to an element of an aerosol-generating device capable of emitting an indication in the form of a haptic to a user of the device. A haptic output unit may, for example, comprise a vibration motor or a haptic motor, such as an eccentric rotating mass actuator.

As used herein, the term 'light emitting indicator' refers to an element of an aerosol-generating device capable of emitting an indication in the form of light visible to a user of the device.

As used herein, the term 'light emitting unit' refers to a discrete component of a light emitting indicator capable of emitting light. Each light emitting unit provides a single display area of the light emitting indicator. A light emitting unit may, for example, be an individual light bulb or an individual LED. Light emitted by the light emitting unit is visible to a user of the aerosol-generating device. A light emitting unit may be mounted such that it projects through a housing of the aerosol-generating device. A light emitting unit may be enclosed within a housing of the aerosol-generating device such that light emitted from the light emitting unit is visible through a window of the aerosol-generating device. Light emitted from a light emitting unit may be transmitted along a waveguide structure such that it is visible to a user of the device.

As used herein, the term 'motion detection unit' refers to an element of an aerosol-generating device capable of detection motion and/or orientation of the device. A motion detection unit may, as an example, comprise an accelerometer and/or a gyroscope.

As used herein, the term 'gesture' refers to a movement of an aerosol-generating device made by a user. A gesture may be a movement of the device in a predetermined manner.

The invention is defined in the claims. However, below there is provided a non-exhaustive list of non-limiting examples. Any one or more of the features of these examples may be combined with any one or more features of another example, embodiment, or aspect described herein.

Example i. An aerosol-generating device for generating an aerosol from an aerosol-forming substrate, the aerosol-generating device being configured to generate the aerosol during a usage session, the aerosol-generating device comprising:

a controller configured to monitor progress of the usage session and control an indicator to indicate progress of the usage session.

Example ii. An aerosol-generating device for generating an aerosol from an aerosol-forming substrate, the aerosol-generating device being configured to generate the aerosol during a usage session, the aerosol-generating device comprising:

an indicator system, a motion detection unit configured to detect movement of the device and identify a gesture associated with the detected movement, and a controller, in which, in response to the gesture being identified by the motion detection unit, the controller is configured to control the indicator system to output a user detectable indication indicative of progress of the usage session or the number of usage sessions available.

Example iii. An aerosol-generating device according to example ii in which the gesture is a first gesture of a plurality of gestures capable of being identified by the motion detection unit.

Example Ex1. An aerosol-generating device for generating an aerosol from an aerosol-forming substrate, the aerosol-generating device being configured to generate the aerosol during a usage session, the aerosol-generating device comprising:

an indicator system, a motion detection unit configured to detect movement of the device and identify a first gesture associated with the detected movement, and a controller, in which, in response to the first gesture being identified by the motion detection unit, the controller is configured to control the indicator system to output a user detectable indication indicative of progress of the usage session or the number of usage sessions available.

Example Ex2. An aerosol-generating device according to any preceding example, the aerosol-generating device being configured to generate the aerosol during a usage session, the aerosol-generating device comprising:

an indicator system, a motion detection unit configured to detect movement of the device and identify a first gesture associated with the detected movement and a second gesture different to the first gesture associated with the detected movement, and a controller, in which, in response to the first gesture being identified by the motion detection unit, the controller is configured to control the indicator system to output a user detectable indication indicative of progress of the usage session, and in response to the second gesture being identified by the motion detection unit the controller is configured to control the indicator system to output a user detectable indication indicative of the number of usage sessions available.

Example Ex3. An aerosol-generating device according to any preceding example configured to be used for a plurality of discrete usage sessions.

Example Ex4. An aerosol-generating device according to example Ex3 in which the plurality of discrete usage sessions is between 2 and 20 discrete usage sessions.

Example Ex5. An aerosol-generating device according to any of examples Ex1 to Ex4 in which the number of usage sessions available is determined with respect to energy available in the power supply.

Example Ex6. An aerosol-generating device according to any of examples Ex2 to Ex5 in which, in response to the second gesture being identified by the motion detection unit, the controller is configured to receive information indicative of energy available in the power supply, and to control the indicator system to output a user detectable indication indicative of number of usage sessions available.

Example Ex7. An aerosol-generating device according to example Ex6 in which, the power supply is a battery and the energy available in the power supply is the charge available in the battery.

Example Ex8. An aerosol-generating device according to example Ex7 in which, the aerosol-generating device is configured to provide an integral number of usage sessions when the battery is fully charged, the integral number being between 2 and 20.

Example Ex9. An aerosol-generating device according to any preceding example in which the motion detection unit comprises an accelerometer and/or a gyroscope.

Example Ex10. An aerosol-generating device according to any preceding example in which the first gesture or the second gesture is identified by the motion detection unit is a gesture selected from the list comprising; lifting the device to a vertical position, shaking the device, tapping the device a predetermined number of times, for example double tapping the device, raising the device, twirling the device, and moving the device in a specific pattern.

Example Ex11. An aerosol-generating device according to any preceding example in which, the indicator system comprises a light emitting indicator.

Example Ex12. An aerosol-generating device according to any preceding example in which, the indicator system comprises a haptic feedback unit.

Example Ex13. An aerosol-generating device according to any preceding example in which the user detectable indication indicative of progress of the usage session comprises an audible indication.

Example Ex14. An aerosol-generating device according to any preceding example in which the user detectable indication indicative of progress of the usage session comprises a haptic indication.

Example Ex15. An aerosol-generating device according to any preceding example in which the user detectable indication indicative of progress of the usage session comprises a visual indication.

Example Ex16. An aerosol-generating device according to any of examples Ex2 to Ex15 in which the user detectable indication indicative of number of usage sessions available comprises an audible indication.

Example Ex17. An aerosol-generating device according to any of examples Ex2 to Ex16 in which the user detectable indication indicative of number of usage sessions available comprises a haptic indication.

Example Ex18. An aerosol-generating device according to any of examples Ex2 to Ex17 in which the user detectable indication indicative of number of usage sessions available comprises a visual indication.

Example Ex19. An aerosol-generating device according to any preceding example in which the usage session extends between a session start and a session stop.

Example Ex20. An aerosol-generating device according to any preceding example in which the aerosol-generating device is configured such that the usage session has a maximum duration determined by a timer.

Example Ex21. An aerosol-generating device according to any preceding example in which the aerosol-generating device is configured to receive an aerosol-generating article comprising the aerosol-forming substrate Example Ex22. An aerosol-generating device according to example Ex21 in which the aerosol-generating device is configured to detect the presence of the aerosol-generating article.

Example Ex23. An aerosol-generating device according to example Ex21 or Ex22 in which the usage session is terminated if the aerosol-generating article is removed from the aerosol-generating device.

Example Ex24. An aerosol-generating device according to any preceding example in which the aerosol-generating device is configured to monitor a user interaction parameter indicative of use of the aerosol-generating device during the usage session.

Example Ex25. An aerosol-generating device according to example Ex24 in which the usage session is configured to be terminated if the user interaction parameter reaches a predetermined threshold.

Example Ex26. An aerosol-generating device according to example Ex24 or Ex25 in which the user interaction parameter is indicative of user puffs taken during the usage session, or in which the user interaction parameter is indicative of volume of aerosol released by the aerosol-forming substrate, or delivered to the user, during the usage session.

Example Ex27. An aerosol-generating device according to any preceding example in which the aerosol-generating device comprises a puff counting mechanism to determine number of user puffs taken during the usage session.

Example Ex28. An aerosol-generating device according to example Ex27 in which the aerosol-generating device is configured to terminate the usage session when the number of user puffs taken during the usage session reaches a predetermined threshold.

Example 28A. An aerosol-generating device according to any preceding example configured to monitor a parameter indicative of aerosol generation during operation of the aerosol-generating device, analyse the monitored parameter to identify a user puff, the user puff defined by a puff start and a puff end, analyse the monitored parameter during the user puff to calculate a puff volume, the puff volume being a volume of aerosol generated during the user puff, and use the puff volume as the user interaction parameter.

Example Ex29. An aerosol-generating device according to any preceding example, in which the usage session comprises a plurality of sequential phases.

Example Ex30. An aerosol-generating device according to example Ex29 in which the plurality of sequential phases are at least three sequential phases.

Example Ex31. An aerosol-generating device according to example Ex29 in which the plurality of sequential phases are at least four sequential phases.

Example Ex32. An aerosol-generating device according to example Ex29 in which the plurality of sequential phases are at least five sequential phases.

Example Ex33. An aerosol-generating device according to any of examples Ex29 to Ex32 in which the controller is configured to control an indicator to display a different one of a plurality of different indication modes during each of the plurality of sequential phases.

Example Ex34. An aerosol-generating device according to any of examples Ex29 to Ex33 in which the aerosol-generating device is configured such that any, or each, of the plurality of sequential phases has a phase duration defined by a phase start and a phase end.

Example Ex35. An aerosol-generating device according to any of examples Ex29 to Ex33 in which the aerosol-generating device is configured such that any, or each, of the plurality of sequential phases has a maximum phase duration determined by a timer.

Example Ex36. An aerosol-generating device according to any of examples Ex29 to Ex34 in which any, or each, of the plurality of sequential phases has phase duration determined by a phase start and a phase end.

Example Ex37. An aerosol-generating device according to example Ex36 in which, and in which any, or each, of the plurality of sequential phases has a maximum phase duration determined by a timer.

Example Ex38. An aerosol-generating device according to example Ex36 or Ex37 in which any, or each, of the plurality of sequential phases ends when a monitored period of time reaches a predetermined threshold for the phase, if the phase has not ended sooner.

Example Ex39. An aerosol-generating device according to any of examples Ex36 to Ex38 in which, a first phase of the plurality of sequential phases has a first phase duration defined by a first phase start and a first phase end, in which the first phase starts at the session start.

Example Ex40. An aerosol-generating device according to example Ex39, in which the first phase includes a heating period in which a heating element increases in temperature from an ambient temperature to an operational temperature for generating an aerosol.

Example Ex41. An aerosol-generating device according to any preceding example in which, a first phase of the plurality of sequential phases has a first phase duration defined by a first phase start and a first phase end, in which the first phase starts at the end of a pre-phase heating period, the pre-phase heating period starting at the session start.

Example Ex42. An aerosol-generating device according to example Ex41 in which the pre-phase heating period is a heating period in which a heating element increases in temperature from an ambient temperature to an operational temperature for generating an aerosol.

Example Ex43. An aerosol-generating device according to any preceding example in which, a second phase of the plurality of sequential phases has a second phase duration defined by a second phase start and a second phase end, in which the second phase starts at the end of the first phase.

Example Ex44. An aerosol-generating device according to any preceding example in which, a third phase of the plurality of sequential phases has a third phase duration defined by a third phase start and a third phase end, in which the third phase starts at the end of the second phase.

Example Ex45. An aerosol-generating device according to any preceding example in which, a fourth phase of the plurality of sequential phases has a fourth phase duration defined by a fourth phase start and a fourth phase end, in which the fourth phase starts at the end of the third phase.

Example Ex46. An aerosol-generating device according to any preceding example in which the usage session ends at the end of the fourth phase.

Example Ex47. An aerosol-generating device according to any of examples Ex1 to Ex45 in which, a fifth phase of the plurality of sequential phases has a fifth phase duration defined by a fifth phase start and a fifth phase end, in which the fifth phase starts at the end of the fourth phase.

Example Ex48. An aerosol-generating device according to example Ex47 in which the usage session ends at the end of the fifth phase.

Example Ex49. An aerosol-generating device according to any of examples Ex1 to Ex45 and Ex47 in which, a sixth phase of the plurality of sequential phases has a sixth phase duration defined by a sixth phase start and a sixth phase end, in which the sixth phase starts at the end of the fifth phase.

Example Ex50. An aerosol-generating device according to example Ex49 in which the usage session ends at the end of the sixth phase.

Example Ex51. An aerosol-generating device according to any preceding example in which the aerosol-generating device comprises monitoring apparatus configured to monitor a user interaction parameter indicative of use of the aerosol-generating device during the usage session.

Example Ex52. An aerosol-generating device according to any preceding example in which duration of any, or each, of the plurality of sequential phases is controlled with reference to the user interaction parameter.

Example Ex53. An aerosol-generating device according to any of examples Ex29 to Ex52 in which a duration of any, or each, of the plurality of sequential phases is controlled with reference to a user interaction parameter and at least one further parameter.

Example Ex54. An aerosol-generating device according to example Ex53 in which the at least one further parameter is passage of time determined by the timer.

Example Ex55. An aerosol-generating device according to any of examples Ex29 to Ex54 in which the user interaction parameter is indicative of user puffs taken during the usage session.

Example Ex56. An aerosol-generating device according to any of examples Ex29 to Ex55 in which the user interaction parameter is indicative of power supplied to a heating element during the usage session.

Example Ex57. An aerosol-generating device according to any of examples Ex29 to Ex56 in which the aerosol-generating device comprises a puff counting mechanism to determine number of user puffs taken during the usage session and in which duration of any, or each, of the plurality of sequential phases is controlled with reference to the number of user puffs taken during the usage session.

Example Ex58. An aerosol-generating device according to any of examples Ex29 to Ex56, in which in which the aerosol-generating device is configured such that the usage session has a maximum usage session duration determined by a timer, and in which the aerosol-generating device is configured to record at least one user interaction parameter during the usage session, the phase duration of any, or each, of the plurality of sequential phases having a duration less than the maximum phase duration if the value of the user interaction parameter reaches a predetermined threshold.

Example Ex59. An aerosol-generating device according to any preceding example in which the usage session comprises a first phase, a second phase, a third phase and a fourth phase.

Example Ex60. An aerosol-generating device according to example Ex59 in which the first phase starts at the session start of the usage session.

Example Ex61. An aerosol-generating device according to example Ex59 or Ex60 wherein the first phase ends and the second phase starts after a monitored period of time starting at a time monitoring start reaches a predetermined first phase time threshold, or after the recorded user interaction parameter reaches a first predetermined value if the first predetermined value is reached at a time preceding the predetermined first phase time threshold.

Example Ex62. An aerosol-generating device according to any of examples Ex59 to Ex61 wherein the second phase ends and the third phase starts after a monitored time starting at the time monitoring start reaches a predetermined second phase time threshold, or after the recorded user interaction parameter reaches a second predetermined value if the second predetermined value is reached at a time preceding the predetermined second phase time threshold.

Example Ex63. An aerosol-generating device according to any of examples Ex59 to Ex62 wherein the third phase ends and the fourth phase starts after a monitored time starting at the time monitoring start reaches a predetermined third phase time threshold, or after the recorded user interaction parameter reaches a third predetermined value if the third predetermined value is reached at a time preceding the predetermined third phase time threshold.

Example Ex64. An aerosol-generating device according to any of examples Ex59 to Ex63 wherein the fourth phase ends after a monitored time starting at the time monitoring start reaches a predetermined fourth phase time threshold, or after the recorded user interaction parameter reaches a fourth predetermined value if the fourth predetermined value is reached at a time preceding the predetermined fourth phase time threshold.

Example Ex65. An aerosol-generating device according to any of examples Ex59 to Ex64 in which the time monitoring start is the session start of the usage session.

Example Ex66. An aerosol-generating device according to any of examples Ex59 to Ex65 in which the first phase time threshold is a value of between 75 seconds and 105 seconds from the session start of the usage session.

Example Ex67. An aerosol-generating device according to any of examples Ex59 to Ex66 in which the recorded user interaction parameter is representative of number of puffs taken by a user during the usage session, the first predetermined value being 3 puffs or 4 puffs.

Example Ex68. An aerosol-generating device according to any of examples Ex59 to Ex67 in which the second phase time threshold is a value of between 150 seconds and 210 seconds from the session start of the usage session.

Example Ex69. An aerosol-generating device according to any of examples Ex59 to Ex68 in which the recorded user interaction parameter is representative of number of puffs taken by a user during the usage session, the second predetermined value being 6 puffs or 7 puffs.

Example Ex70. An aerosol-generating device according to any of examples Ex59 to Ex69 in which the third phase time threshold is a value of between 225 seconds and 315 seconds from the session start of the usage session.

Example Ex71. An aerosol-generating device according to any of examples Ex59 to Ex70 in which the recorded user interaction parameter is representative of number of puffs taken by a user during the usage session, the third predetermined value being 9 puffs or 10 puffs.

Example Ex72. An aerosol-generating device according to any of examples Ex59 to Ex71 in which the fourth phase time threshold is a value of between 300 seconds and 420 seconds from the session start of the usage session.

Example Ex73. An aerosol-generating device according to any of examples Ex59 to Ex74 in which the recorded user interaction parameter is representative of number of puffs taken by a user during the usage session, the first predetermined value being 12 puffs or 13 puffs.

Example Ex74. An aerosol-generating device according to any of example Ex59 to Ex73 in which, the usage session comprises a final phase, which may be the fourth phase or a subsequent phase, and the final phase ends after a monitored time starting at the session start of the usage session reaches a predetermined final phase time threshold, or after the recorded user interaction parameter reaches a final predetermined value if the final predetermined value is reached before the predetermined final phase time threshold.

Example Ex75. An aerosol-generating device according to example Ex74 in which the final phase has a maximum duration that is shorter than the maximum duration of preceding phases.

Example Ex76. An aerosol-generating device according to any preceding example in which the indicator system comprises a light emitting indicator.

Example Ex77. An aerosol-generating device according to example Ex76 in which the light emitting indicator has at least one light emitting unit and no more than two light emitting units.

Example Ex78. An aerosol-generating device according to example Ex77 in which the, or each, light emitting unit is a LED unit.

Example Ex79. An aerosol-generating device according to any of examples Ex77 to Ex78 in which, the or each light emitting unit is configured to display in at least three operational states.

Example Ex80. An aerosol-generating device according to example Ex79 wherein the at least three operational states are selected from a list comprising; consistently on, consistently off, blinking, and intensity modulated.

Example Ex81. An aerosol-generating device according to any of examples Ex77 to Ex80 in which the or each light emitting unit is capable of being operated to emit light in a first colour and in a second colour, the or each light emitting unit configured to display in a plurality of operational states.

Example Ex82. An aerosol-generating device according to any of examples Ex77 to Ex81 in which the light emitting indicator comprises a single light emitting unit capable of being operated to emit light in a first colour and in a second colour, the light emitting unit configured to display a plurality of operational states, the light emitting indicator thereby capable of displaying in a plurality of indication modes.

Example Ex83. An aerosol-generating device according to example Ex82 wherein the plurality of operational states are selected from the list comprising: consistently off, first colour consistently on, first colour blinking, first colour intensity modulated, second colour consistently on, second colour blinking, second colour intensity modulated, and alternate first colour/second colour blinking.

Example Ex84. An aerosol-generating device according to any of examples Ex77 to Ex83 in which the light emitting unit is configured to display in at least three operational modes and the light emitting indicator is thereby capable of displaying in at least three indication modes.

Example Ex85. An aerosol-generating device according to any of examples Ex77 to Ex84 in which the light emitting unit is configured to display in at least four operational modes and the light emitting indicator is thereby capable of displaying in at least four indication modes.

Example Ex86. An aerosol-generating device according to any of examples Ex77 to Ex85 in which the light emitting unit is configured to display in at least five operational modes and the light emitting indicator is thereby capable of displaying in at least five indication modes.

Example Ex87. An aerosol-generating device according to any of examples Ex76 to Ex81 in which the light emitting indicator consists of two light emitting units, a first light emitting unit and a second light emitting unit, each of the light emitting units configured to display in a first operational state, a second operational state, and a third operational state, and in which the controller is configured to independently control the operational state of the first light emitting unit and the second light emitting unit to any one of a first, second, or third operational states such that the light emitting indicator displays in at least four indication modes.

Example Ex88. An aerosol-generating device according to example Ex87 configured such that he light emitting indicator displays in at least five indication modes.

Example Ex89. An aerosol-generating device according to any of examples Ex76 to Ex88 in which the usage session comprises at least four sequential phases and the light emitting indicator is configured to display a different indication mode at or during each of the sequential phases.

Example Ex90. An aerosol-generating device according to example Ex89 in which during a first phase the light emitting indicator displays in a first indication mode resulting from the first light emitting unit displaying a first operational state and the second light emitting unit displaying a first operational state.

Example Ex91. An aerosol-generating device according to example Ex89 or example Ex90 in which during a second phase the light emitting indicator displays in a second indication mode resulting from the first light emitting unit displaying a first operational state and the second light emitting unit displaying a second operational state Example Ex92. An aerosol-generating device according to any one of examples Ex89 to Ex91 in which during a third phase the light emitting indicator displays in a third indication mode resulting from the first light emitting unit displaying a first operational state and the second light emitting unit displaying a third operational state Example Ex93. An aerosol-generating device according to any one of examples Ex89 to Ex92 in which during a fourth phase the light emitting indicator displays in a fourth indication mode resulting from the first light emitting unit displaying a second operational state and the second light emitting unit displaying a second operational state.

Example Ex94. An aerosol-generating device according to any one of examples Ex89 to Ex93 in which during a fifth phase the light emitting indicator displays in a fifth indication mode resulting from the first light emitting unit displaying a third operational state and the second light emitting unit displaying a third operational state.

Example Ex95. An aerosol-generating device according to any preceding example in which the indicator system comprises a haptic output unit.

Example Ex96. An aerosol-generating device according to example Ex95 in which the usage session comprises a plurality of sequential phases and the haptic output unit is configured to emit a different haptic output during each of the plurality of sequential phases.

Example Ex97. An aerosol-generating device according to example Ex96 in which, during a first phase the haptic output unit emits an output selected from the list comprising a single vibration, a double vibration, a triple vibration, and a quadruple vibration.

Example Ex98. An aerosol-generating device according to example Ex97 in which, during a second phase the haptic output unit emits an output selected from the list comprising a single vibration, a double vibration, a triple vibration, and a quadruple vibration, the haptic output emitted during the second phase being different to the haptic output emitted during the first phase.

Example Ex99. An aerosol-generating device according to example Ex98 in which, during a third phase the haptic output unit emits an output selected from the list comprising a single vibration, a double vibration, a triple vibration, and a quadruple vibration, the haptic output emitted during the third phase being different to the haptic output emitted during both of the first phase and the second phase.

Example Ex100. An aerosol-generating device according to example Ex99 in which, during a fourth phase the haptic output unit emits an output selected from the list comprising a single vibration, a double vibration, a triple vibration, and a quadruple vibration, the haptic output emitted during the fourth phase being different to the haptic output emitted during any of the first phase, the second phase, and the third phase.

Example Ex101. An aerosol-generating device according to any preceding example in which the device comprises a heater.

Example Ex102. An aerosol-generating device according to example Ex101 in which the heater is an induction heater.

Example Ex103. An aerosol-generating device according to example Ex101 in which the heater is a resistance heater.

Example Ex104. An aerosol-generating device according to any preceding example configured to receive an aerosol-generating article comprising the aerosol-forming substrate.

Example Ex105. An aerosol-generating device according to example Ex104 in which the aerosol-forming substrate is a solid aerosol-forming substrate.

Example Ex105i. An aerosol-generating device according to any of examples Ex101 to Ex105 in which power is supplied to the heater to maintain the heater at a predetermined temperature during the usage session.

Example 105ii. An aerosol-generating device according to any of examples Ex101 to Ex105i in which power is supplied to the heater to increase the temperature of a heater element to an operating temperature range for generating an aerosol, the heater element remaining within the operating temperature range until the end of the usage session.

Example 105iii. An aerosol-generating device according to any of examples Ex 101 to Ex105ii in which power is supplied to the heater during the usage session both when a user is taking a puff and when a user is not taking a puff.

Example Ex106. An aerosol-generating system comprising an aerosol-generating device according to any preceding example and an aerosol-generating article configured to be received by the aerosol-generating device, the aerosol-generating article comprising the aerosol-forming substrate.

Example Ex107. A method of providing user information in an aerosol-generating device for generating an aerosol from an aerosol-forming substrate during a usage session, the aerosol-generating device comprising:

an indicator system, and a motion detection unit configured to detect movement of the device and identify a gesture associated with the detected movement, the method comprising steps of;

detecting movement of the device, determining if the movement corresponds to the gesture, and if the movement corresponds to the gesture, controlling the indicator system to output a user detectable indication indicative of progress of the usage session.

Example Ex108. A method of providing user information in an aerosol-generating device for generating an aerosol from an aerosol-forming substrate during a usage session, the aerosol-generating device comprising:

a power supply, an indicator system, and a motion detection unit configured to detect movement of the device and identify a first gesture associated with the detected movement and a second gesture different to the first gesture associated with the detected movement, the method comprising steps of detecting movement of the device, determining if the movement corresponds to the first gesture or the second gesture, and if the movement corresponds to the first gesture, controlling the indicator system to output a user detectable indication indicative of progress of the usage session, and if the movement corresponds to the second gesture controlling the indicator system to output a user detectable indication indicative of number of usage sessions available.

Example Ex109. A method of providing user information according to example Ex107 or Ex108 in an aerosol-generating device according to any of examples Ex1 to Ex105, the method comprising the steps of;

detecting and identifying a gesture made by a user holding the aerosol-generating device, in response to the gesture being a first gesture, controlling the indicator system to output a user detectable indication indicative of progress of the usage session.

Example Ex110. A method according to example Ex109 in which, in response to the gesture being a second gesture, controlling the indicator system to output a user detectable indication indicative of number of usage sessions available.

Example Ex111. A method according to any of examples Ex107 to Ex110 comprising the further steps of; defining a plurality of sequential phases between a user session start and a user session stop, and in response to the gesture being the first gesture, controlling the indicator system to output a different output during each of the plurality of sequential phases of the usage session.

Example Ex112. A method according to any of examples Ex107 to Ex111 comprising the further steps of, recording a user interaction parameter during the usage session, and determining the duration of each of a plurality of sequential phases of the usage session based on timing information and a value of the user interaction parameter.

Example Ex113. An aerosol-generating device for generating an aerosol from an aerosol-forming substrate, the aerosol-generating device being configured to generate the aerosol during a usage session, the aerosol-generating device comprising:

an indicator system, a motion detection unit configured to detect movement of the device and identify a first gesture associated with the detected movement, and a controller, in which, the aerosol-generating device comprises a computer readable medium containing instructions to carry out a method according to any of examples Ex107 to Ex112.

Example Ex114. An aerosol-generating device for generating an aerosol from an aerosol-forming substrate, the aerosol-generating device being configured to generate the aerosol during a usage session, the aerosol-generating device comprising:

a power supply, an indicator system, a motion detection unit configured to detect movement of the device and identify a gesture associated with the detected movement, and a controller, in which, in response to the gesture being identified by the motion detection unit the controller is configured to control the indicator system to output a user detectable indication indicative of number of usage sessions available.

Example Ex115. An aerosol-generating device according to example Ex114 configured to be used for a plurality of discrete usage sessions.

Example Ex116. An aerosol-generating device according to example Ex115 in which the plurality of discrete usage sessions is between 2 and 20 discrete usage sessions.

Example Ex117. An aerosol-generating device according to any of examples Ex114 to Ex116 in which the number of usage sessions available is determined with respect to energy available in the power supply.

Example Ex118. An aerosol-generating device according to any of examples Ex114 to Ex117 in which, in response to the gesture being identified by the motion detection unit, the controller is configured to receive information indicative of energy available in the power supply, and to control the indicator system to output a user detectable indication indicative of number of usage sessions available.

Example Ex119. An aerosol-generating device according to example Ex118 in which, the power supply is a battery and the energy available in the power supply is the charge available in the battery.

Example Ex120. An aerosol-generating device according to example Ex119 in which, the aerosol-generating device is configured to provide an integral number of usage sessions when the battery is fully charged, the integral number being between 2 and 20.

Example Ex121. An aerosol-generating device according to any of examples Ex114 to Ex120 in which the motion detection unit comprises an accelerometer.

Example Ex122. An aerosol-generating device according to any of examples Ex114 to Ex121 in which the gesture identified by the motion detection unit is a gesture selected from the list comprising; lifting the device to a vertical position, shaking the device, tapping the device a predetermined number of times, for example double tapping the device, raising the device, twirling the device, and moving the device in a specific pattern.

Example Ex123. An aerosol-generating device according to any of examples Ex114 to Ex122 in which, the indicator system comprises a light emitting indicator.

Example Ex124. An aerosol-generating device according to any of examples Ex114 to Ex123 in which, the indicator system comprises a haptic feedback unit.

Example Ex125. An aerosol-generating device according to any of examples Ex114 to Ex124 in which the user detectable indication indicative of number of usage sessions available comprises an audible indication.

Example Ex126. An aerosol-generating device according to any of examples Ex114 to Ex125 in which the user detectable indication indicative of number of usage sessions available comprises a haptic indication.

Example Ex127. An aerosol-generating device according to any of examples Ex114 to Ex126 in which the user detectable indication indicative of number of usage sessions available comprises a visual indication.

Example Ex128. An aerosol-generating device according to any of examples Ex114 to Ex127 in which the usage session extends between a session start and a session stop.

Example Ex129. An aerosol-generating device according to any of examples Ex114 to Ex128 in which the aerosol-generating device is configured such that the usage session has a maximum duration determined by a timer.

Example Ex130. An aerosol-generating device according to any of examples Ex114 to Ex129 in which the aerosol-generating device is configured to receive an aerosol-generating article comprising the aerosol-forming substrate Example Ex131. An aerosol-generating device according to example Ex130 in which the aerosol-generating device is configured to detect the presence of the aerosol-generating article.

Example Ex132. An aerosol-generating device according to example Ex130 or Ex131 in which the usage session is terminated if the aerosol-generating article is removed from the aerosol-generating device.

Example Ex133. A method of providing user information in an aerosol-generating device for generating an aerosol from an aerosol-forming substrate during a usage session, the aerosol-generating device comprising:

a power supply, an indicator system, and a motion detection unit configured to detect movement of the device and identify a gesture associated with the detected movement, the method comprising steps of detecting movement of the device, determining if the movement corresponds to the gesture, and if the movement corresponds to the gesture, controlling the indicator system to output a user detectable indication indicative of number of usage sessions available.

Example Ex134. A method of providing user information according to example Ex133 in an aerosol-generating device according to any of examples Ex114 to Ex132.

Example Ex135. An aerosol-generating device for generating an aerosol from an aerosol-forming substrate, the aerosol-generating device being configured to generate the aerosol during a usage session, the aerosol-generating device comprising:

a power supply, an indicator system, a motion detection unit configured to detect movement of the device and identify a gesture associated with the detected movement, and a controller, in which, the aerosol-generating device comprises a computer readable medium containing instructions to carry out a method according to any of examples Ex133 to Ex134.

Specific embodiments of the invention will now be described with reference to figures, in which.

Figure 9:
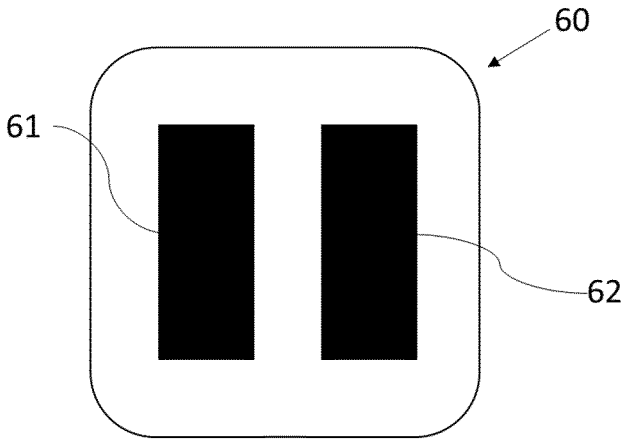
Figure 10:
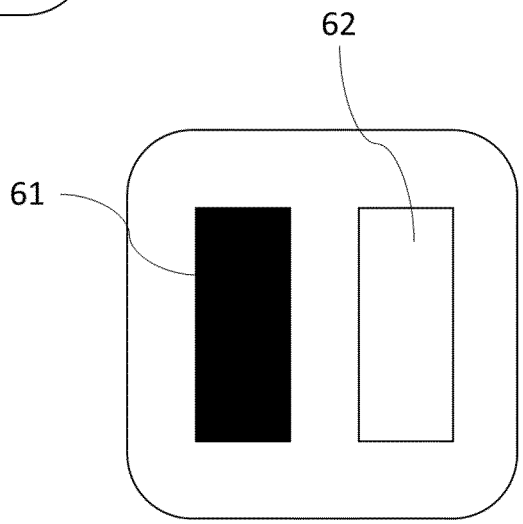
Figure 11:
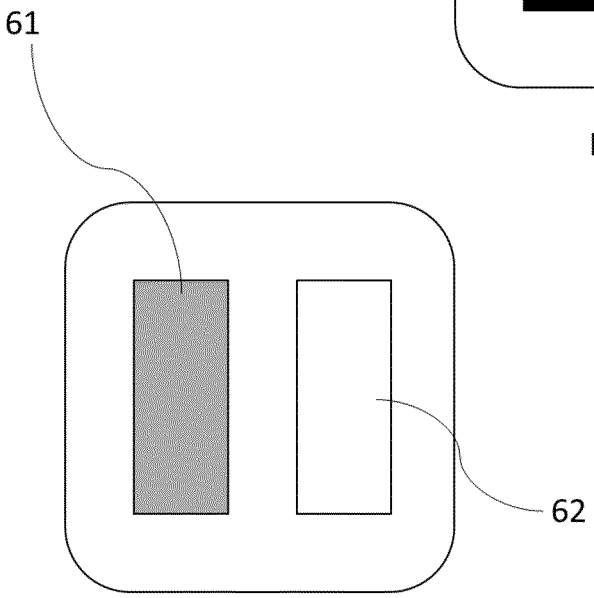

FIGS. 9 to 11 provide a schematic illustration of exemplary indications that may be provided by a light emitting indicator to indicate number of usage sessions remaining; and FIGS. 12 to 16 provide schematic illustration of exemplary indications that may be provided by a light emitting indicator to progress of a usage session.

The aerosol-generating device 10 is a hand-held aerosol generating device, and has an elongate shape defined by a housing 20 that is substantially circularly cylindrical in form. The aerosol-generating device 10 comprises an open cavity 25 located at a proximal end 21 of the housing 20 for receiving an aerosol-generating article 30 comprising an aerosol-forming substrate 31. The aerosol-generating device 10 further comprises a battery (not shown) located within the housing 20 of the device, and an electrically operated heater 40 arranged to heat at least an aerosol-forming substrate portion 31 of an aerosol-generating article 30 when the aerosol-generating article 30 is received in the cavity 25.

The aerosol-generating device is configured to receive a consumable aerosol-generating article 30. The aerosol-generating article 30 is in the form of a cylindrical rod and comprises an aerosol-forming substrate 31. The aerosol-forming substrate is a solid aerosol-forming substrate comprising tobacco. The aerosol-generating article 30 further comprises a mouthpiece such as a filter 32 arranged in coaxial alignment with the aerosol-forming substrate within the cylindrical rod. The aerosol-generating article 30 has a diameter substantially equal to the diameter of the cavity 25 of the device 10 and a length longer than a depth of the cavity 25, such that when the article 30 is received in the cavity 25 of the device 10, the mouthpiece 32 extends out of the cavity 25 and may be drawn on by a user, similarly to a conventional cigarette.

In use, a user inserts the article 30 into the cavity 25 of the aerosol-generating device 10 and turns on the device 10 by pressing a user button 50 to activate the heater 40 to start a usage session. The heater 40 heats the aerosol-forming substrate of the article 30 such that volatile compounds of the aerosol-forming substrate 31 are released and atomised to form an aerosol. The user draws on the mouthpiece of the article 30 and inhales the aerosol generated from the heated aerosol-forming substrate. After activation, the temperature of the heater 40 increases from an ambient temperature to a predetermined temperature for heating the aerosol-forming substrate. Control electronics of the device 10 supply power to the heater from the battery to maintain the temperature of the heater at an approximately constant level as a user puffs on the aerosol-generating article 30. The heater continues to heat the aerosol-generating article until an end of the usage session, when the heater is deactivated and cools.

At the end of the usage session, the article 30 is removed from the device 10 for disposal, and the device 10 may be coupled to an external power source for charging of the battery of the device 10.

The aerosol-generating device 10 further comprises a light emitting indicator 60 having a first light emitting unit 61 and a second light emitting unit 62. Light emitted from the first light emitting unit 61 and the second light emitting unit 62 is visible through the housing 20 of the aerosol-generating device 10. The first light emitting unit 61 and the second light emitting unit 62 are both light emitting diode (LED) devices capable of emitting light in four colours; white, green, red, and amber. The LEDs may be visible through the housing 20, or light emitted from the LEDs may be visible from outside the housing 20 through a light transmission channel (for instance, via a waveguide or similar structure). In addition to each being able to emit light in different colours, the first light emitting unit and the second light emitting unit are both capable of being independently controlled to be fully off, fully on, or blinking on and off.

Figure 2:
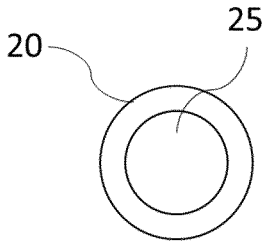
FIG. 2 illustrates a schematic upper end view of the aerosol-generating device of FIG. 1.
Figure 1:
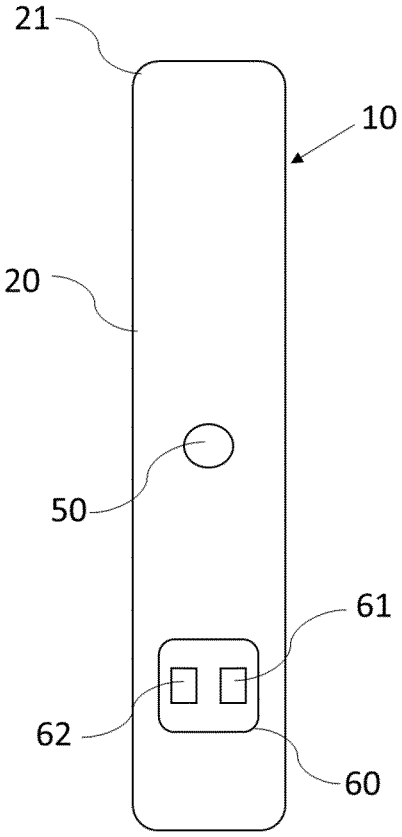
FIG. 1 illustrates a schematic side view of an aerosol-generating device.
Figure 3:
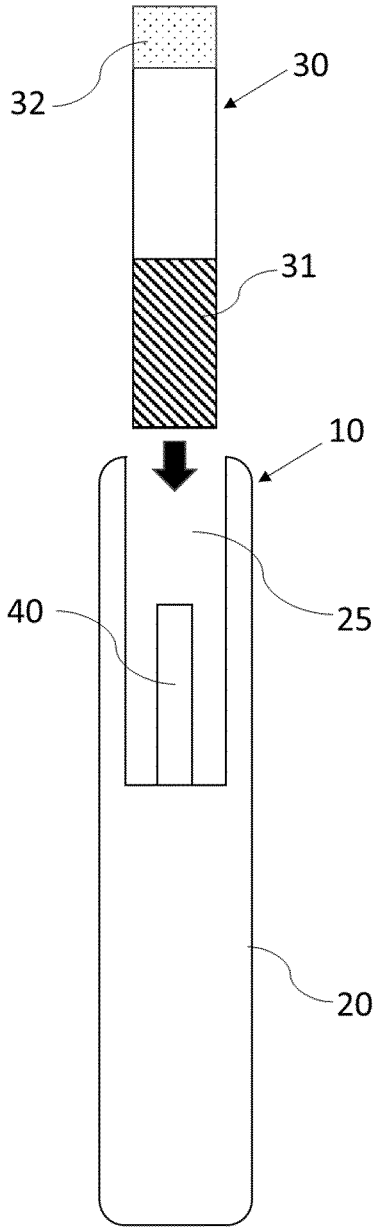
FIG. 3 illustrates a schematic cross-sectional side view of the aerosol-generating device of FIG. 1 and an aerosol-generating article for use with the device.
Figure 4:
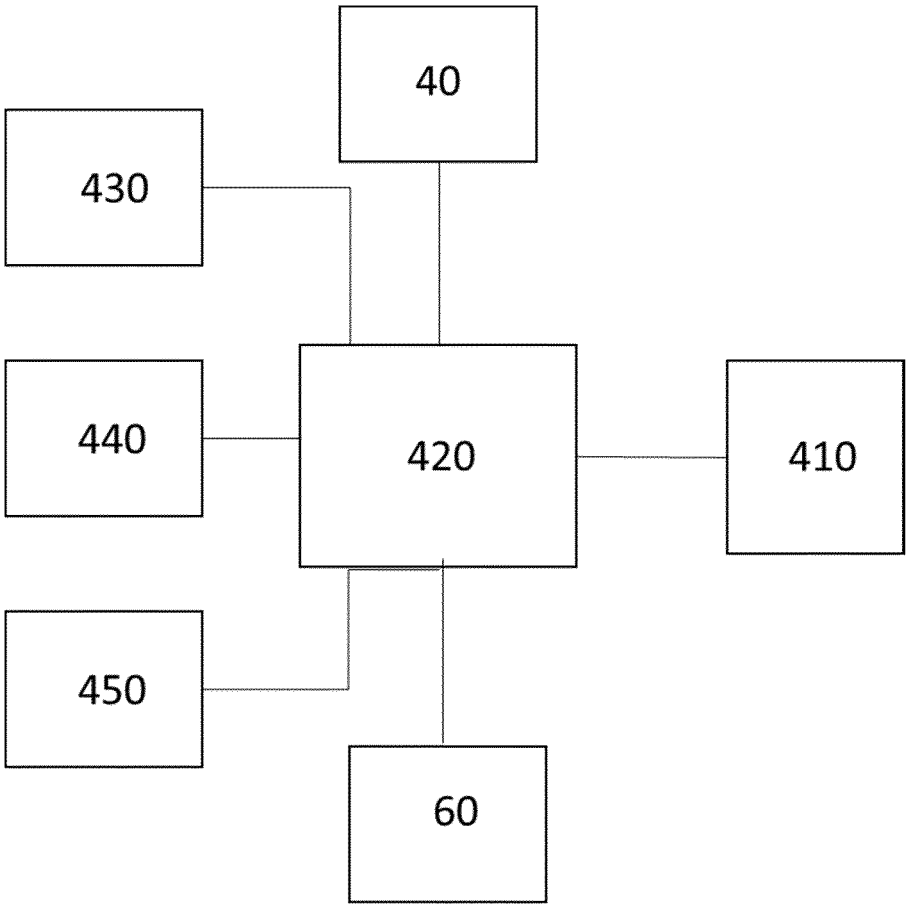
FIG. 4 is a block diagram providing a schematic illustration of various electronic components of an aerosol-generating device and their interactions.

FIG. 4 provides a schematic illustration of various electronic components of the aerosol-generating device and their interactions.

A controller 420, located within the housing 20, is connected to a battery 410, a heater 40, a timer 430, an accelerometer 440, a haptic motor 450, and a light emitting indicator 60.

The battery 410 supplies energy to heat the heater 40 and operate other electrical components. The battery 410 has, when fully charged, sufficient energy to power two complete usage session of the aerosol-generating device. The battery 410 is a rechargeable battery and can be connected to an external power supply to be recharged.

The heater 40 converts energy supplied by the battery into heat to heat the aerosol-generating device sufficiently to form an aerosol. During operation, the controller controls supply of energy from the battery to maintain the heater at a substantially constant aerosol-generating temperature.

The timer 430 provides timing signals to the controller.

The accelerometer 440 is configured for detecting movement of the device. When movement is detected a signal is sent to the controller and the controller determines whether the detected movement conforms to a predetermined pattern or gesture. Thus, a user can interact with the device by causing it to move in specific patterns and gestures.

The haptic motor 450 generates a haptic output to a user of the device. The haptic motor is configured to emit a haptic output in response to a control signal from the controller 420.

The light emitting indicator 60 generates a visual indication to a user. The light emitting indicator is configured to emit a visual indication in response to a control signal from the controller 420.

The aerosol-generating device 10 of this specific embodiment is configured to accept user queries in the form of specific gestures made by the user with the device 10. In response to user queries, the device 10 is configured to output signals indicative of number of usage sessions remaining before the battery of the device needs to be recharged, and, during a usage session, signals indicative of progress of the usage session.

When fully charged, the battery can provide sufficient energy for at least one full usage sessions. The battery may provide sufficient energy for two or more usage session (for instance, twenty usage sessions). A user may wish to know how many usage sessions are available before attempting to start a usage session.

Figure 5:
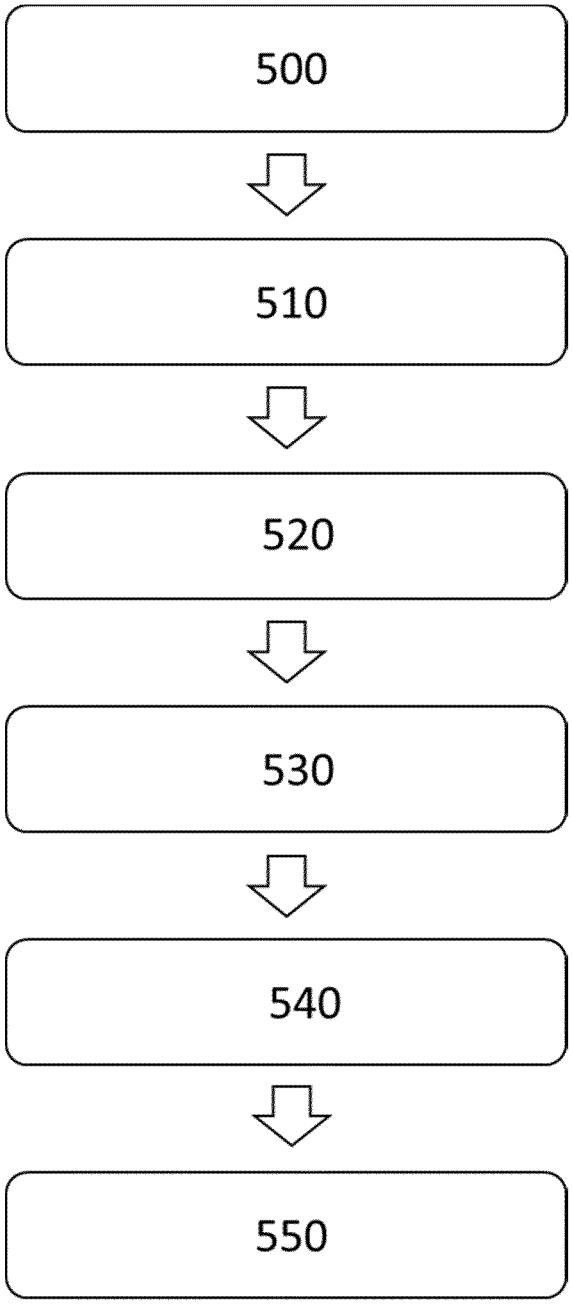
FIG. 5 is a flow diagram illustrating method steps involved in providing a user with an indication of number of usage sessions remaining.

FIG. 5 is a flow diagram illustrating method steps involved in providing a user with an indication of number of usage sessions remaining.

Step 500: When the aerosol-generating device is not engaged in a usage session, the user picks up the device and moves the device in a predetermined gesture.

Step 510: The movement of the device associated with the predetermined gesture is detected by the accelerometer, which sends a signal to the controller. The predetermined gesture may be, for example, to lift the device and orient the device in a vertical position.

Step 520: The signal provided by the accelerometer is analysed to determine if the gesture detected is a gesture indicating a battery status query.

Step 530: If the detected signal is determined to be a battery status query, the controller communicates with the battery to determine the level of charge of the battery.

Step 540: The controller sends a signal to the light emitting indicator 60 to emit an indication of the number of usage sessions remaining.

Step 550: The light emitting indicator 60 emits a visual signal indicative of the number of usage sessions remaining.

FIGS. 9 to 11 provide a schematic illustration of exemplary indications that may be provided by the light emitting indicator 60 to indicate number of usage sessions remaining. If the controller determines that the battery has sufficient charge for 2 usage sessions, the light emitting indicator emits an indication that two usage sessions remain; for example the first light emitting unit 61 and the second light emitting unit 62 may both be illuminated with a white light.

If the controller determines that the battery has sufficient charge for 1 usage session, the light emitting indicator 60 emits an indication that one usage session remains; for example the first light emitting unit 61 may both be illuminated with a white light and the second light emitting unit 62 may be unlit.

If the controller determines that the battery has insufficient charge for a usage session, the light emitting indicator emits an indication that no usage sessions are available and the battery needs recharging; for example the first light emitting unit 61 may both be illuminated with a yellow light and the second light emitting unit 62 may be unlit.

An aerosol-generating article for use with the device has a finite quantity of aerosol-forming substrate and, thus, a usage session needs to have a finite duration to prevent a user trying to produce aerosol when the aerosol-forming substrate has been depleted. A usage session is configured to have a maximum duration determined by a period of time from the start of the usage session. A usage session is also configured to have a duration of less than the maximum duration if a user interaction parameter recorded during the usage session reaches a threshold before the maximum duration as determined by the timer.

In a specific embodiment the user interaction parameter is number of puffs taken by the user during the usage session. Thus, the aerosol-generating device is configured such that each usage session has a duration of 6 minutes from initiation of the usage session, or 14 puffs taken by the user if 14 puffs are taken within 6 minutes from initiation of the usage session.

During a usage session, a user may wish to have an indication of progress through the usage session. For example, the user may wish to know approximately how many puffs he has remaining, or approximately how much time there remains in the usage session.

The controller comprises a puff counter to monitor number of puffs taken during a usage session. Number of puffs taken by the user is determined by monitoring power supplied to the heater during the usage session. When a user takes a puff, the flow of air cools the heater and, therefore, a greater amount of energy is supplied by the battery to maintain the temperature of the heater at its operational temperature. Thus, by monitoring power supplied by the heater, the controller is able to determine the number of puffs taken during a usage session.

In order to monitor progress, a usage session is split into a number of sequential phases starting with a first phase starting when the usage session starts and ending with a final phase when the usage session ends, passage from one phase to a next phase being determined by time and puff number in the same way as the usage session. As the usage session progresses through its sequential phases, the controller instructs the light emitting indicator and the haptic motor to emit signals indicative of each successive phase. Thus, a user knows approximately the progress of the usage session.

Figure 6:
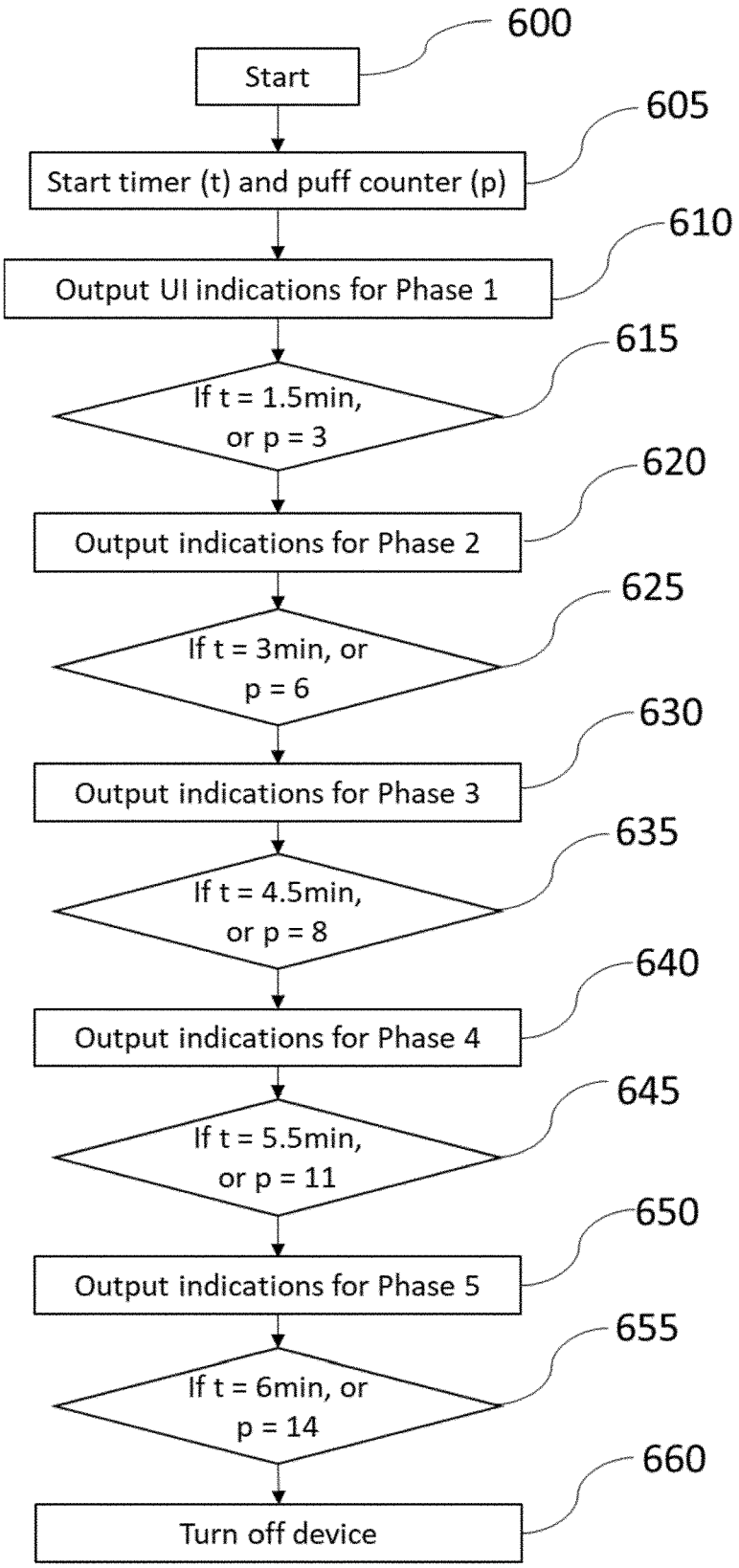
FIG. 6 is a flow diagram illustrating method steps involved in indicating progress of a usage session to a user, where progress is determined by time and puff count.

In a specific example a usage session may be broken into five sequential phases for indication purposes. FIG. 6 illustrates the method steps involved in indicating progress of a usage session to a user.

Step 600: The user inserts an aerosol-generating article 30 into the cavity 25 of the device 10 and initiates a usage session by pressing the user button 50.

Step 605: The timer is initiated to record time elapsed during the usage session and the puff counter is initiated to record number of puffs taken during the usage session.

Step 610: A first phase of the usage session is deemed to have started when the usage session started.

Figure 12:
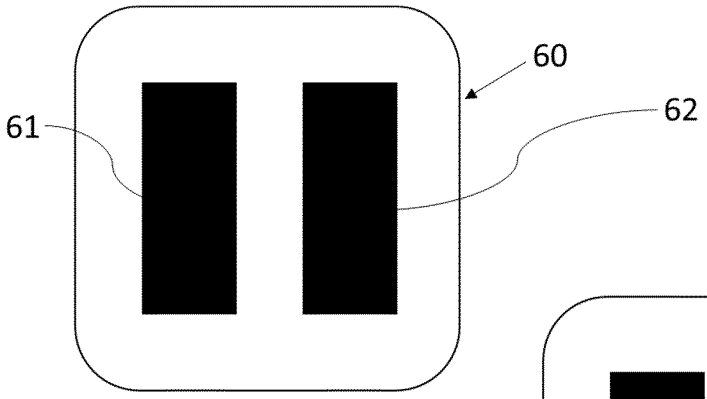

While in the first phase the controller instructs the light emitting indicator 60 to emit a signal indicative of the usage session being in the first phase. An example of such a signal is the first light emitting unit 61 and the second light emitting unit 62 both emitting a continuous white light, as illustrated in FIG. 12.

While in the first phase the controller instructs the haptic motor to emit a haptic signal indicative of the usage session being in the first phase. An example of such a signal is the haptic motor emitting 4 consecutive buzzes.

Step 615: The first phase ends and the second phase begins after 1.5 minutes have elapsed from the start of the usage session, or after a user has taken 3 puffs since the start of the usage session, if those 3 puffs are taken before 1.5 minutes has elapsed from the start of the usage session.

Step 620: The second phase of the usage session is deemed to have started when the first phase has ended.

Figure 13:
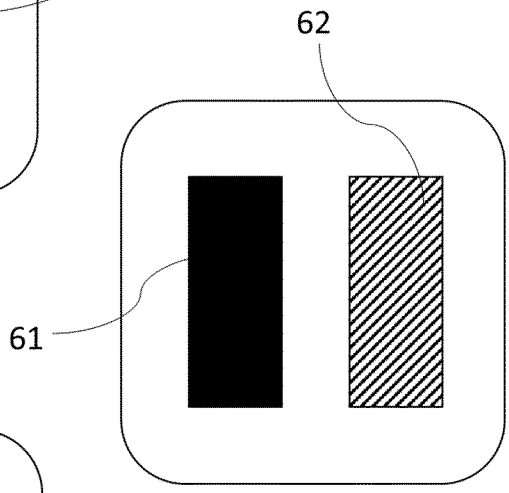

While in the second phase the controller instructs the light emitting indicator 60 to emit a signal indicative of the usage session being in the second phase. An example of such a signal is the first light emitting unit 61 emitting a continuous white light and the second light emitting unit 62 emitting a blinking white light, as illustrated in FIG. 13.

While in the second phase the controller instructs the haptic motor to emit a haptic signal indicative of the usage session being in the second phase. An example of such a signal is the haptic motor emitting 3 consecutive buzzes.

Step 625: The second phase ends and the third phase begins after 3 minutes have elapsed from the start of the usage session, or after a user has taken 6 puffs since the start of the usage session, if those 6 puffs are taken before 3 minutes has elapsed from the start of the usage session.

Step 630: The third phase of the usage session is deemed to have started when the second phase has ended.

Figure 14:
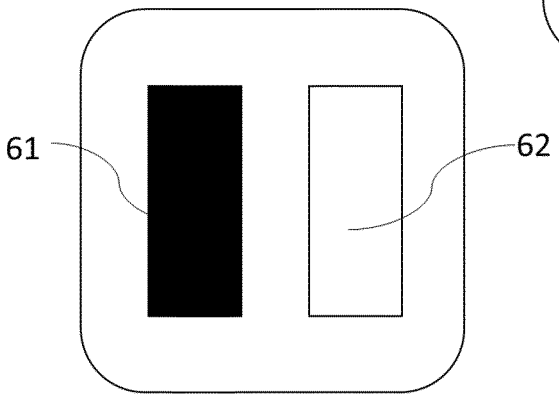

While in the third phase the controller instructs the light emitting indicator 60 to emit a signal indicative of the usage session being in the third phase. An example of such a signal is the first light emitting unit 61 emitting a continuous white light and the second light emitting unit 62 being unlit, as illustrated in FIG. 14.

While in the third phase the controller instructs the haptic motor to emit a haptic signal indicative of the usage session being in the third phase. An example of such a signal is the haptic motor emitting 2 consecutive buzzes.

Step 635: The third phase ends and the fourth phase begins after 4.5 minutes have elapsed from the start of the usage session, or after a user has taken 8 puffs since the start of the usage session, if those 8 puffs are taken before 4.5 minutes has elapsed from the start of the usage session.

Step 640: The fourth phase of the usage session is deemed to have started when the third phase has ended.

Figure 15:
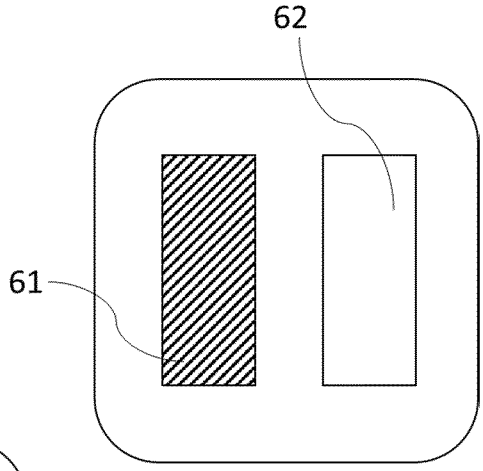

While in the fourth phase the controller instructs the light emitting indicator 60 to emit a signal indicative of the usage session being in the fourth phase. An example of such a signal is the first light emitting unit 61 emitting a blinking white light and the second light emitting unit 62 being unlit, as illustrated in FIG. 15.

While in the fourth phase the controller instructs the haptic motor to emit a haptic signal indicative of the usage session being in the fourth phase. An example of such a signal is the haptic motor emitting a single buzz.

Step 645: The fourth phase ends and the fifth phase begins after 5.5 minutes have elapsed from the start of the usage session, or after a user has taken 11 puffs since the start of the usage session, if those 11 puffs are taken before 5.5 minutes has elapsed from the start of the usage session.

Step 650: The fifth phase of the usage session is deemed to have started when the fourth phase has ended.

Figure 16:
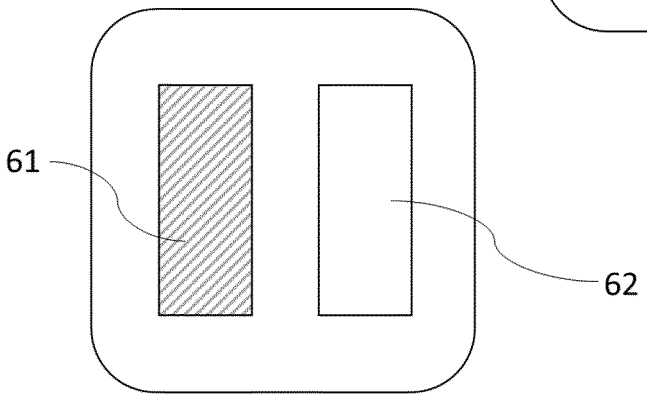

While in the fifth phase the controller instructs the light emitting indicator 60 to emit a signal indicative of the usage session being in the fifth phase. An example of such a signal is the first light emitting unit 61 emitting a blinking yellow light and the second light emitting unit 62 being unlit, as illustrated in FIG. 16.

Step 655: The fifth phase ends after 6 minutes have elapsed from the start of the usage session, or after a user has taken 14 puffs since the start of the usage session, if those 14 puffs are taken before 6 minutes has elapsed from the start of the usage session.

Step 660: At the end of the fifth phase the usage session ends. The heater is deactivated and no more aerosol is generated. The user can now remove the aerosol generating article from the device and, if necessary, recharge the device.

In a further specific embodiment the user interaction parameter is calculated volume of aerosol delivered to the user during the usage session. Thus, the aerosol-generating device is configured such that each usage session has a duration of 6 minutes from initiation of the usage session, or delivery of a predetermined maximum volume of aerosol, if that predetermined volume of aerosol is delivered to the user within 6 minutes from initiation of the usage session. The predetermined maximum volume of aerosol may be, for example, 660 ml of aerosol.

During a usage session, a user may wish to have an indication of progress through the usage session. For example, the user may wish to know approximately how much potentially deliverable aerosol he has remaining, or approximately how much time there remains in the usage session.

The controller is configured to detect puffs taken during a usage session. A puff start point and a puff end point for each detected puff is determined by monitoring power supplied to the heater during the usage session. When a user takes a puff, the flow of air cools the heater and, therefore, a greater amount of energy is supplied by the battery to maintain the temperature of the heater at its operational temperature. Thus, by monitoring power supplied by the heater, the controller is able to determine the start point and the end point of puffs taken during a usage session. By integrating the monitored power between the detected puff start point and the detected puff end point, a calculated value for aerosol delivered may be obtained. By summing the calculated values of aerosol delivered during the usage session, a cumulative value of aerosol delivered during the usage session may be obtained.

In order to monitor progress, a usage session is split into a number of sequential phases starting with a first phase starting when the usage session starts and ending with a final phase when the usage session ends, passage from one phase to a next phase being determined by time and cumulative volume of aerosol delivered. As the usage session progresses through its sequential phases, the controller instructs the light emitting indicator and the haptic motor to emit signals indicative of each successive phase. Thus, a user knows approximately the progress of the usage session.

Figure 7:
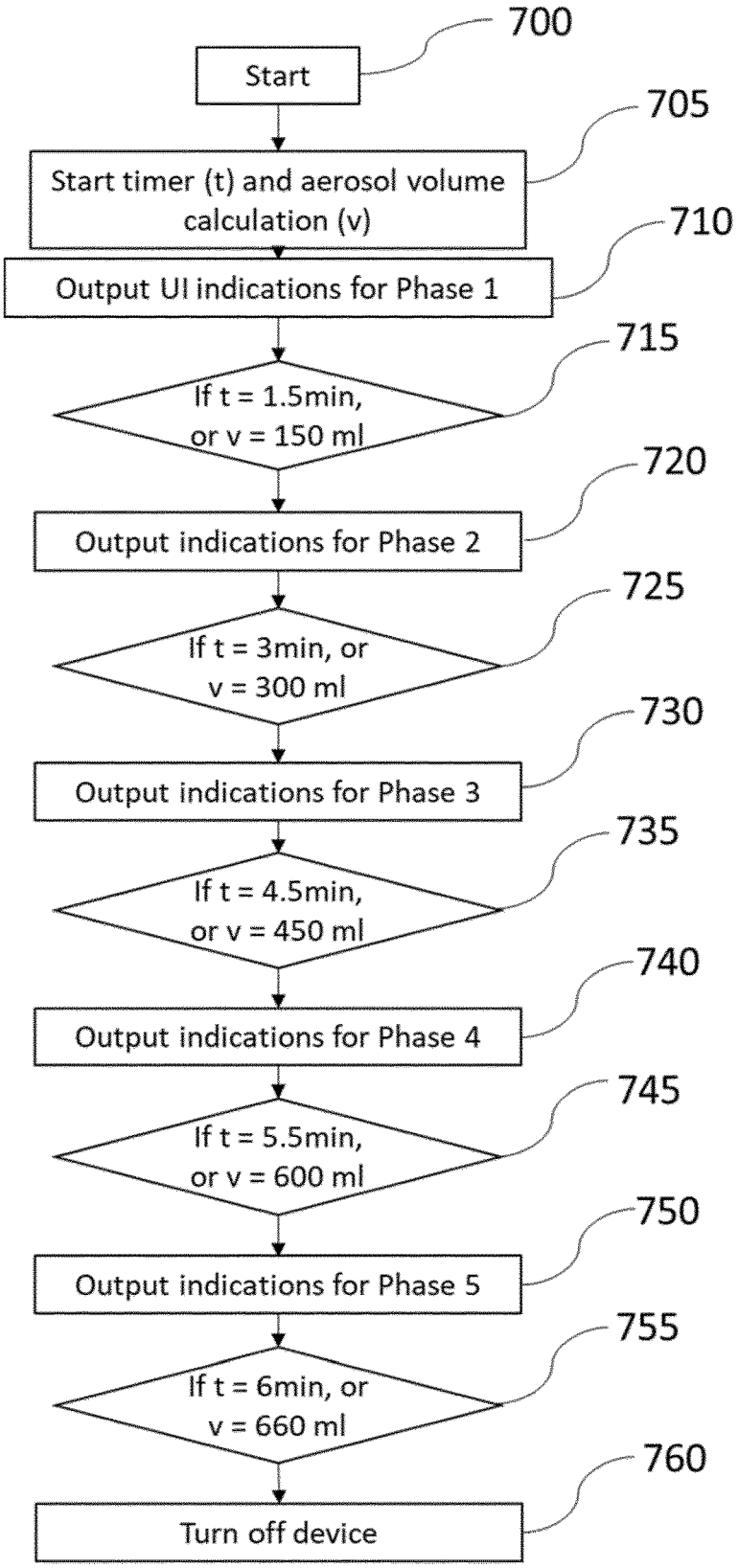
FIG. 7 is a flow diagram illustrating method steps involved in indicating progress of a usage session to a user, where progress is determined by time and aerosol volume generated.

In a specific example a usage session may be broken into five sequential phases for indication purposes. FIG. 7 illustrates the method steps involved in indicating progress of a usage session to a user.

Step 700: The user inserts an aerosol-generating article 30 into the cavity 25 of the device 10 and initiates a usage session by pressing the user button 50.

Step 705: The timer is initiated to record time elapsed during the usage session and the controller is initiated to identify puffs taken during the usage session and calculate volume of aerosol delivered during each of the puffs.

Step 710: A first phase of the usage session is deemed to have started when the usage session started.

While in the first phase the controller instructs the light emitting indicator 60 to emit a signal indicative of the usage session being in the first phase. An example of such a signal is the first light emitting unit 61 and the second light emitting unit 62 both emitting a continuous white light, as illustrated in FIG. 11.

While in the first phase the controller instructs the haptic motor to emit a haptic signal indicative of the usage session being in the first phase. An example of such a signal is the haptic motor emitting 4 consecutive buzzes.

Step 715: The first phase ends and the second phase begins after 1.5 minutes have elapsed from the start of the usage session, or after a first predetermined volume of aerosol has been delivered since the start of the usage session, if the first predetermined volume of aerosol is delivered before 1.5 minutes has elapsed from the start of the usage session. The first predetermined volume of aerosol may be, for example, 150 ml.

Step 720: The second phase of the usage session is deemed to have started when the first phase has ended.

While in the second phase the controller instructs the light emitting indicator 60 to emit a signal indicative of the usage session being in the second phase. An example of such a signal is the first light emitting unit 61 emitting a continuous white light and the second light emitting unit 62 emitting a blinking white light, as illustrated in FIG. 12.

While in the second phase the controller instructs the haptic motor to emit a haptic signal indicative of the usage session being in the second phase. An example of such a signal is the haptic motor emitting 3 consecutive buzzes.

Step 725: The second phase ends and the third phase begins after 3 minutes have elapsed from the start of the usage session, or after a second predetermined volume of aerosol has been delivered since the start of the usage session, if the second predetermined volume of aerosol is delivered before 3 minutes has elapsed from the start of the usage session. The first predetermined volume of aerosol may be, for example, 300 ml.

Step 730: The third phase of the usage session is deemed to have started when the second phase has ended.

While in the third phase the controller instructs the light emitting indicator 60 to emit a signal indicative of the usage session being in the third phase. An example of such a signal is the first light emitting unit 61 emitting a continuous white light and the second light emitting unit 62 being unlit, as illustrated in FIG. 13.

While in the third phase the controller instructs the haptic motor to emit a haptic signal indicative of the usage session being in the third phase. An example of such a signal is the haptic motor emitting 2 consecutive buzzes.

Step 735: The third phase ends and the fourth phase begins after 4.5 minutes have elapsed from the start of the usage session, or after a third predetermined volume of aerosol has been delivered since the start of the usage session, if the third predetermined volume of aerosol is delivered before 4.5 minutes has elapsed from the start of the usage session. The third predetermined volume of aerosol may be, for example, 450 ml.

Step 740: The fourth phase of the usage session is deemed to have started when the third phase has ended.

While in the fourth phase the controller instructs the light emitting indicator 60 to emit a signal indicative of the usage session being in the fourth phase. An example of such a signal is the first light emitting unit 61 emitting a blinking white light and the second light emitting unit 62 being unlit, as illustrated in FIG. 14.

While in the fourth phase the controller instructs the haptic motor to emit a haptic signal indicative of the usage session being in the fourth phase. An example of such a signal is the haptic motor emitting a single buzz.

Step 745: The fourth phase ends and the fifth phase begins after 5.5 minutes have elapsed from the start of the usage session, or after a fourth predetermined volume of aerosol has been delivered since the start of the usage session, if the fourth predetermined volume of aerosol is delivered before 5.5 minutes has elapsed from the start of the usage session. The fourth predetermined volume of aerosol may be, for example, 600 ml.

Step 750: The fifth phase of the usage session is deemed to have started when the fourth phase has ended.

While in the fifth phase the controller instructs the light emitting indicator 60 to emit a signal indicative of the usage session being in the fifth phase. An example of such a signal is the first light emitting unit 61 emitting a blinking yellow light and the second light emitting unit 62 being unlit, as illustrated in FIG. 15.

Step 755: The fifth phase ends after 6 minutes have elapsed from the start of the usage session, or after a fifth predetermined volume of aerosol has been delivered since the start of the usage session, if the fifth predetermined volume of aerosol is delivered before 6 minutes has elapsed from the start of the usage session. The fifth predetermined volume of aerosol may be, for example, 660 ml.

Step 760: At the end of the fifth phase the usage session ends. The heater is deactivated and no more aerosol is generated. The user can now remove the aerosol generating article from the device and, if necessary, recharge the device.

Indication of the different phases may be continuously provided. For example, indication from the light emitting indicator may remain continuously on during the usage session. As an alternative, indication of different phases may only be provided intermittently, for example at the transition from one phase to another. As a further alternative, indication of the different phases may be provided in response to a status query from a user during the usage session.

Figure 8:
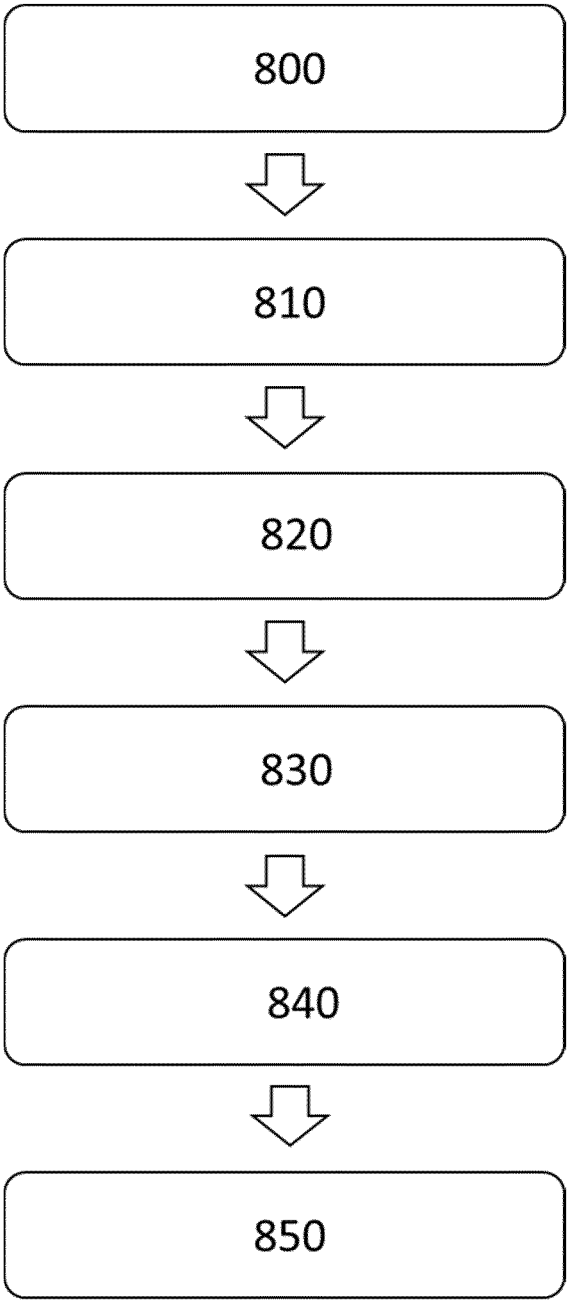
FIG. 8 is a flow diagram illustrating method steps involved in providing a user with an indication of progress of a usage session in response to a status query.

FIG. 8 is a flow diagram illustrating method steps involved in providing a user with an indication of progress of a usage session in response to a status query.

Step 800: When the aerosol-generating device is engaged in a usage session, the user moves the device in a predetermined gesture.

Step 810: The movement of the device associated with the predetermined gesture is detected by the accelerometer, which sends a signal to the controller. The predetermined gesture may be, for example, to sharply tap the device twice.

Step 820: The signal provided by the accelerometer is analysed to determine if the gesture detected is a gesture indicating a usage session progress query.

Step 830: If the detected signal is determined to be a usage session progress query, the controller determines the current phase of the usage session.

Step 840: The controller sends a signal to the light emitting unit to emit an indication of the progress of the usage session.

Step 850: The controller sends a signal to the haptic motor to emit an indication of the progress of the usage session.

The device may be configured such that both visual and haptic indication signals are automatically emitted as an indication of progress. As an alternative, the device may be configured such that visual indication signals are provided continuously during a usage session while haptic signals are only provided in response to a query from a user. For example, haptic signals indicative of usage progression may only be emitted after a user has initiated a status query by moving the device in a predetermined gesture. As a further alternative, the device may be configured such that signals relating to progression of a usage session are not continuously emitted during usage, but only emitted in response to a query from a user. For example, visual signals and/or haptic signals indicative of usage progression may only be emitted after a user has initiated a status query by moving the device in a predetermined gesture.

The invention claimed is:

1. An aerosol-generating device for generating an aerosol from an aerosol-forming substrate, the aerosol-generating device being configured to generate the aerosol during a usage session, the aerosol-generating device comprising:

an indicator system;

a motion detection unit; and a controller;

wherein the motion detection unit is configured to detect movement of the aerosol-generating device and to identify a first gesture and a second gesture different from the first gesture, wherein, in response to the first gesture being identified by the motion detection unit, the controller is configured to control the indicator system to output a user detectable indication indicative of progress of the usage session, and wherein, in response to the second gesture being identified by the motion detection unit the controller is further configured to control the indicator system to output a user detectable indication indicative of the number of usage sessions available.

2. The aerosol-generating device according to claim 1, wherein the aerosol-generating device is further configured to be used for a plurality of discrete usage sessions.

3. The aerosol-generating device according to claim 1, wherein the plurality of discrete usage sessions is between 2 discrete usage sessions and 20 discrete usage sessions.

4. The aerosol-generating device according to claim 1, wherein the motion detection unit comprises an accelerometer and/or a gyroscope.

5. The aerosol-generating device according to claim 1, wherein the first gesture or the second gesture identified by the motion detection unit is a gesture selected from a list comprising; lifting the aerosol-generating device to a vertical position, shaking the aerosol-generating device, tapping the aerosol-generating device a predetermined number of times, double-tapping the aerosol-generating device, raising the aerosol-generating device, twirling the aerosol-generating device, and moving the aerosol-generating device in a specific pattern.

6. The aerosol-generating device according to claim 1, wherein the usage session extends between a session start and a session stop.

7. The aerosol-generating device according to claim 1, wherein the aerosol-generating device is further configured such that the usage session has a maximum duration determined by a timer.

8. The aerosol-generating device according to claim 1, wherein the aerosol-generating device is further configured to monitor a user interaction parameter indicative of use of the aerosol-generating device during the usage session.

9. The aerosol-generating device according to claim 8, wherein the usage session is configured to be terminated if the user interaction parameter reaches a predetermined threshold.

10. The aerosol-generating device according to claim 8, wherein the user interaction parameter is indicative of user puffs taken during the usage session.

11. The aerosol-generating device according to claim 1, wherein the usage session comprises a plurality of sequential phases.

12. The aerosol-generating device according to claim 11, wherein the controller is further configured to control an indicator to display a different one of a plurality of different indication modes during each of the plurality of sequential phases.

13. The aerosol-generating device according to claim 11, wherein any, or each, of the plurality of sequential phases ends when a monitored period of time reaches a predetermined threshold for the phase, if the phase has not ended sooner.

14. The aerosol-generating device according to claim 11, wherein any, or each, of the plurality of sequential phases has a phase duration determined by a phase start and a phase end.

15. The aerosol-generating device according to claim 14, wherein the aerosol-generating device is further configured such that any, or each, of the plurality of sequential phases has a maximum phase duration determined by a timer, and wherein the aerosol-generating device is further configured to record at least one user interaction parameter during the usage session, the phase duration of any, or each, of the plurality of sequential phases having a duration less than the maximum phase duration if the value of the user interaction parameter reaches a predetermined threshold.

* * * * *